United States Patent [19]

Brunius et al.

[11] Patent Number: 4,737,770

[45] Date of Patent: Apr. 12, 1988

[54] SECURITY SYSTEM WITH PROGRAMMABLE SENSOR AND USER DATA INPUT TRANSMITTERS

[75] Inventors: Robert E. Brunius; Jon R. Nelson, both of St. Paul, Minn.; William W. Williamson, Somerset, Wis.

[73] Assignee: Interactive Technologies, Inc., North St. Paul, Minn.

[21] Appl. No.: 837,208

[22] Filed: Mar. 10, 1986

[51] Int. Cl.[4] ..... G08B 1/08; G08B 26/00

[52] U.S. Cl. ..... 340/539; 340/506; 340/531

[58] Field of Search ..... 340/539, 506, 505, 518, 340/531–538, 521, 825.22, 825.27, 825.34, 825.36, 825.5, 825.44, 825.49, 525, 365 E; 179/5 R, 5 P; 364/550; 379/37

[56] References Cited

U.S. PATENT DOCUMENTS

| | | | |
|---|---|---|---|
| 3,848,231 | 11/1974 | Wootton | 340/539 |
| 4,228,424 | 10/1980 | Le Nay et al. | 340/506 |
| 4,463,349 | 7/1984 | Mochida et al. | 340/365 E |
| 4,465,904 | 8/1984 | Gottsegen et al. | 340/518 |
| 4,581,606 | 4/1986 | Mallory | 340/506 |

*Primary Examiner*—Donnie L. Crosland
*Attorney, Agent, or Firm*—Douglas L. Tschida

[57] ABSTRACT

A family of serially programmable integrated circuit transmitters for use in various sensor and user data input transmitters of a short-range radio frequency linked security system. Each transmitter transmits two bits of data for each data frame of a pulse position encoded message format with multiples of each message being transmitted with each transmission, the number of messages depending upon the type of message. Each user data input transmitter includes means for decoding keyboard entered data, re-circulating means for storing the user entered data and programmed system parameters and means for time partitioning intra and inter-message transmissions. Each sensor transmitter includes means for storing uniquely programmed system preconditioning parameters, means for sensing and verifying alarm conditions and means for time partitioning intra and inter-message transmissions. A hand-held programming unit permits the programming of each user data input and sensor transmitter with a variety of system pre-conditioning parameters to identify the transmitter to a system controller and the type of transducer coupled to the sensor transmitter.

35 Claims, 26 Drawing Sheets

| | | |
|---|---|---|
| Fig. 7a | Fig. 7b | Fig. 7c |
| Fig. 7d | Fig. 7e | Fig. 7f |
| Fig. 7g | Fig. 7h | Fig. 7i |

Fig. 7

| | | |
|---|---|---|
| Fig. 8a | Fig. 8b | Fig. 8c |
| Fig. 8d | Fig. 8e | Fig. 8f |
| Fig. 8g | Fig. 8h | Fig. 8i |

Fig. 8

70
22 BIT SHIFT REGISTER
/FREQ. SHIFT
KEY 2
KEY 3
KEY 4
KEY 5
ALT FUNC
ROW NO
ROW NO
ROW NO
COL NO
COL NO
F/F
D S Q
C R Q̄
/SR LOAD
KEY 0
KEY 1
/COUNT

SECURITY SYSTEM WITH PROGRAMMABLE SENSOR AND USER DATA INPUT TRANSMITTERS

BACKGROUND OF THE INVENTION

The present invention relates to home security systems and in particular to a short-range wireless security system having a plurality of distributed sensor transmitters, each being coupled to a transducer, and at least one user data input transmitter. Each transmitter is RF coupled to a system controller and which in turn is coupled to a central station. The invention is further characterized in that each distributed transmitter is serially programmable with a plurality of unique system parameters identifying the transmitters and selectable sensor options and which pre-condition pulse position encoded messages transmitted thereby relative to a transducer type, type of sensed condition and the system and transmitter identification data.

With the advance of micro-electronics, wireless home security systems have become economically more feasible. Such systems, like garage door openers, currently and most commonly utilize an RF communications link between various remote sensors and a system controller. Cumbersome and expensive wiring is thus avoided, but in replacement of which it is now necessary to provide means for addressing each message to allow the system controller to identify and distinguish each sensor and the data transmitted thereby. For example, it is necessary to know not only which sensor is transmitting at any given time, but also the type of sensor so as to further determine whether or not an indicated alarm condition is in fact an alarm.

Sensor identification has heretofore typically been achieved by including within each sensor a plurality of DIP switches, fusible links or other physically programmable bistate devices, not to mention hard wiring particular wires to particular pin locations and whereby a unique address is assigned to each transmitter. Thus with each subsequent transmission, the programmed address is transmitted along with sensor condition data, typically a single bit, to enable the system controller to identify the origin of system transmissions. With the exception of each sensor's address, however, essentially no other transmission pre-conditioning has been used. All other signal conditioning, such as timing delays to accommodate the various types of sensors etc., has been relegated to hard wiring either provided in the sensors or at the system controller. Thus, the task has been left to the system controller to decode the sensor transmissions and determine whether or not, (with a change in a sensor's state), a valid alarm is bein detected.

An example of one such system can be seen in U.S. Pat. No. 4,360,801 and wherein a home security garage door operating system is disclosed which is also responsive to toxic gas and heat buildup. Each sensor transmitter in this system is assigned a five-bit address established by five selector switches mounted at each remote sensor module. Light emitting diodes are also provided to confirm address selection. Each transmission, in turn, is encoded via a pulse width modulated transmission schema. Each sensor's address and the state of its associated transducer is thus transmitted as a single message to a central control module whereat the messages are decoded and an appropriate alarm condition is set. Also provided at the central control module is sensor compensation circuitry and which in the case of the carbon monoxide detector comprises time delayed circuitry allowing for warm-up of the associated reference circuitry. Similarly, motor lockout circuitry is provided to prevent against door closure after the detection of carbon monoxide buildup.

Yet another security system and which is dependent upon Manchester phase encoded RF transmissions is disclosed in U.S. Pat. No. 4,257,038. Here again individual short-range RF sensor transmitters are utilized to communicate alarm conditions to a central station and which is responsive to a transmitted change in sensor condition from a pre-set initial condition at the central station. The system is constructed from a family of integrated programmable encoder/decoder circuits, in particular a Model ED-1 encoder/decoder manufactured by Supertex, Inc. These circuits are configurable as either transmitters or receivers and operate on parallel input data that in the case of a transmitter is converted to a serial Manchester encoded output, although without error detection. When configured as a receiver, the circuitry receives, converts and compares the received data to previously programmed data. Alarm conditions are determined by applying a sensor output to a programming input terminal, where it is subsequently transmitted upon enabling the transmitter. Each remote sensor when activated, transmits a uniquely encoded transmission, different from each other transmitter, that is subsequently decoded by the central station to identify the transmitting sensor and indicate a change in state and an alarm condition. All decoding is left to the central station and therefore no pre-conditioning occurs at any of the transmitters.

Still another patent of which applicant is aware is U.S. Pat. No. 4,231,105 and wherein a vending machine control unit is disclosed that is operable in response to data entered via a programming unit. In particular, unit prices may be selectively changed via a connector coupled hand-held programming unit that operates in a byte parallel fashion to re-program an electrically erasable read only memory stored in the control unit. In contrast thereto, the present invention utilizes a battery powered, serially programmable recirculating shift register schema for programming pre-conditioning parameters into the system sensors and user data input transmitters. The present schema also allows the immediate reading of entered data to confirm proper entry.

While systems like those described in the foregoing patents achieve a similar end to the present system, that is, of identifying alarm conditions, the present system is constructed to do so in a fashion which provides for maximum flexibility and ease of system programming. In particular, it achieves this end by permitting the programming of the system sensor transmitters and each user data input transmitter such that the messages transmitted therefrom directly identify to the system controller not only which transmitter is transmitting, but also pre-condition the transmission to account for any peculiarities of its associated transducer. Message processing is thus limited at the system controller. A single sensor transmitter can also be adapted to accommodate a broad range of systems and transducer types in a cost effective fashion. Similarly, multiple user data input transmitters can be used in a single system to facilitate operation.

Accordingly, it is an object of the present invention to enable the programming of the sensor and user data input transmitters via a hand-held system programmer and whereby sensor address, type and a number of sensor or system dependent parameters can be programmed without having to physically disassemble the sensors and/or data input units.

It is another object of the invention to minimize the pin count of each programmable integrated circuit transmitter via serially programmed re-circulating shift registers provided thereat.

It is another object of the invention that each transmitter transmit pulse position encoded messages to the system controller and wherein two bits of data are identified by a single pulse within each data frame pulse and wherein each message is transmitted a multiplicity of times depending upon the message type, thereby assuring reception at the system controller.

It is a still further object of the invention to permit not only the programming of the sensor and user data input transmitters, but also the interrogation of previously programmed system parameters therein.

It is a still further object to allow the programming of each sensor and user data input transmitter with a specific house code.

It is a still further object to provide a plurality of programmable pre-conditioning options at each sensor transmitter identifying ones of the following conditions: supervised, sensor type, sensor switch condition, sensor switch restore, lockout timing, emergency priority, smoke delay and transmitter frequency select; along with sensor identification data identifying the sensor number.

The above objects, advantages and distinctions of the present invention will become more apparent upon reference to the following description thereof with respect to the appended drawings. Before referring thereto, however, it is to be appreciated that the following description is given by way of the presently preferred embodiment only and accordingly various modifications may be made thereto without departing from the spirit and scope of the following described invention. Such description should also not in any way be interpreted to limit the scope of the invention. It is to be further appreciated that to the extent like numerals are used in the various drawings, they described like components.

SUMMARY OF THE INVENTION

A programmable security system including a plurality of sensor and user data input transmitters, each of which are constructed from a common family of integrated circuit transmitters and which are capable of short-range RF communications with a system controller. Each sensor and user data input transmitter is programmable via a plug connected, hand-held programming unit capable of programming a house code, sensor number, sensor type and a plurality of programmable pre-conditioning options including supervised, initial sensor switch position (i.e. an active or inactive state), restored, lockout timing, emergency priority, smoke delay and frequency type. The hand-held unit also allows the interrogation of each sensor and/or user data input transmitter and/or the programming of various of the sensors to a restricted operation state, much like a sleep condition wherein relatively small amounts of power are consumed.

The programmable system pre-conditioning parameters enable the pre-processing of sensed alarm conditions and the identification of the pulse position encoded outputs of the system sensor and user data input transmitters, thereby providing maximum flexibility with a minimum number of part types. Each sensor and user data input transmitter thus accommodates a host of system configurations with a minimum of system setup necessitated at the system controller. System control being relegated to a micro-processor controlled, software driven monitoring of the RF transmissions.

Each sensor and user data input transmitter operates to store the system pre-conditioning parameters, format the pulse position encoded messages and establish the number of messages transmitted with each transmission. Each sensor transmitter essentially comprises a programmable 28-bit recirculating shift register configured to store a house code, sensor number, sensor type, an initial transducer, a restore condition, and to transmit therewith even and odd parity error detection information. Depending upon the sensor input and the selected pre-conditioning options, the sensor transmitter transmits an appropriately configured pulse position encoded message a correspondingly defined number of times to the system controller. Each sensor transmitter is further capable of being programmed to a sleep or non-battery consuming condition.

Each user data input transmitter, in turn, essentially comprises a 22-bit re-circulating shift register which is coupled to a keyboard and keyboard decoding means and message formatting circuitry and by way of which user entered programming data is similarly transmitted a predetermined number of times to the system controller in a pulse position encoded message format. The shift register is operable to store the house code, the row and column data of each selected key, a transmitter identification number, and stroke count and to transmit therewith even and odd parity error detection information. Each message is transmitted an appropriate number of times depending upon whether a non-emergency or emergency key is pressed. An audible signal confirms transmission.

DESCRIPTION OF THE PREFERRED EMBODIMENT

Figure 1:
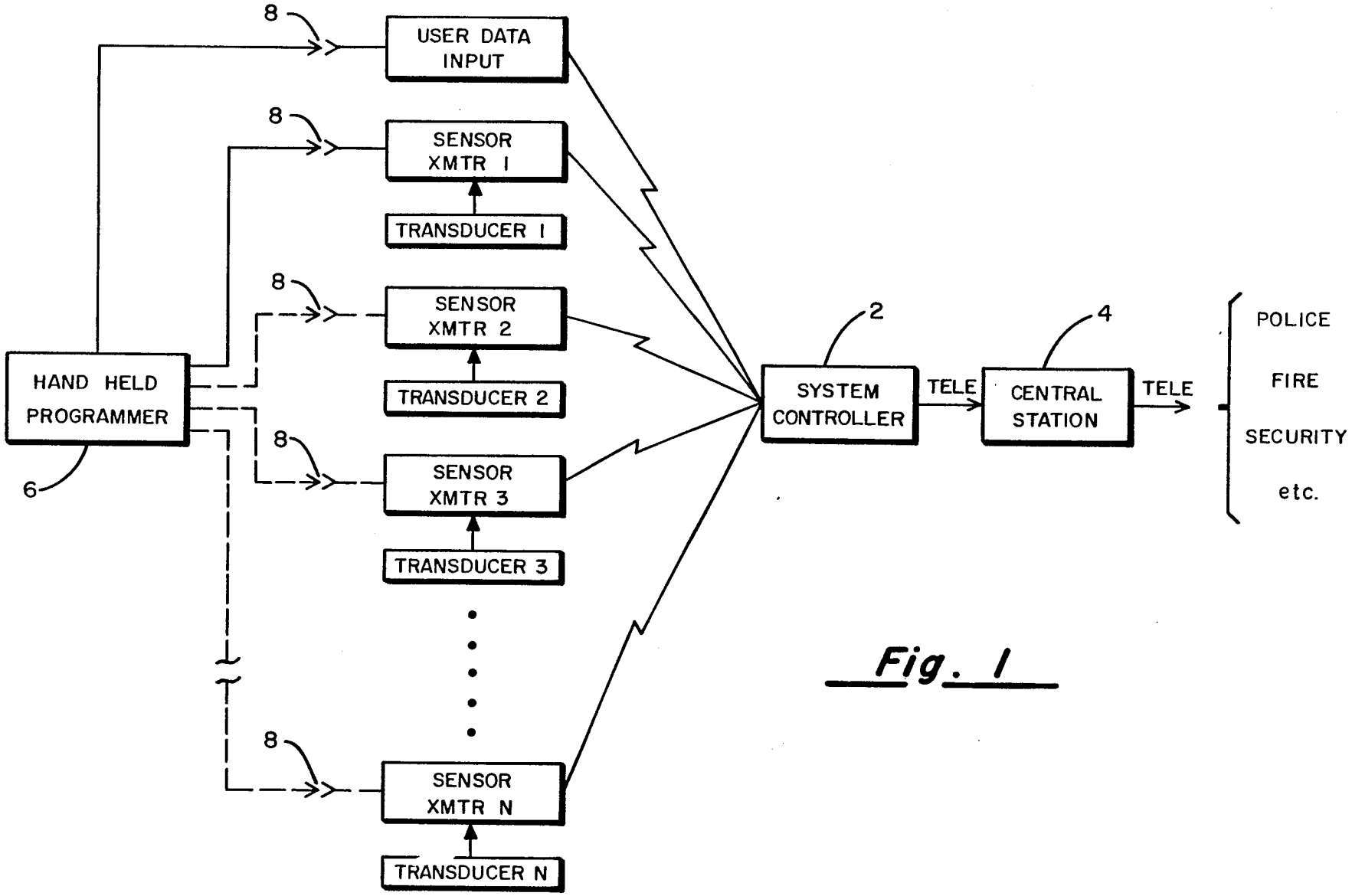
FIG. 1 shows a system block diagram of a typical alarm system including the present invention.

Referring to FIG. 1, a system block diagram is shown of a typical short-range wireless security system as it would be configured using the integrated circuit transmitters of the present invention. Specifically, such a system comprises a plurality of sensor transmitters 1 through N which are distributed about the premises at desired locations in proximity to an associated transducer 1 through N to monitor particular analog conditions thereat. These conditions typically being the opening and closing of doors, windows etc., and which conditions are detectable via magnetic switches, floor mat detectors, smoke detectors, motion detectors or any other number of detectors which are available to the security industry.

Depending upon the sensor type, the system must be conditioned to identify the sensor and its location and to validate its transmitted data. With the exception of an assigned address and possibly a code akin to the present house code, previous systems relegated the conditioning of the sensor transmissions to the system controller 2 and which upon receipt of the RF transmissions from the sensors decoded the transmissions, validated the decoded data and responded with an appropriate action. Such action might for example be the contacting of the central station 4 and which, in turn, may contact the appropriate civil authority, such as the police, fire department or possibly a private security agency via a telephone link.

Because presently available sensors have essentially no capability of being pre-conditioned to their associated transducer or analog detector, the system controller oftentimes presents a complex bottleneck to the system. That is, it becomes a rather complex task to program the controller 2 via software and hardware to appropriately decode the incoming transmissions in a timely fashion. In order to overcome this shortcoming, the present invention and the system of FIG. 1 incorporate into the sensor transmitters 1, 2 and 3 through N as well as the user data input transmitter (hereinafter referred to as the UDI transmitter) a number of programmable options which pre-condition the sensor transmissions, thus freeing up the system controller 2 and/or allow the expansion of the system's capability to handle other inputs without sacrificing present capabilities. In this regard, it is to be further appreciated that more than one UDI transmitter may be used in a system.

In order to further accommodate the present system, the sensor transmitters 1 through N have been constructed to be as small as possible via the compaction of much of the circuitry into a family of custom integrated circuits and which allows for a package, not including the transducer, of approximately one-half inch diameter by three inches in length. Thus, the sensor transmitters are readily mountable in relation to the analog transducers. The constructional details of the transmitters used in the sensor 1 through N and UDI transmitters will be described in detail hereinafter.

Turning attention for the moment, however, to the hand-held programmer 6, it is used during the initial setup of the system to individually program each of the sensor transmitters 1 through N and UDI transmitters with necessary system and pre-conditioning data. In particular, the programmer 6 is individually coupled via a four pin connector 8 to each of the sensor 1 through N and UDI transmitters. With the exception of the first connection to the UDI, each of the successive connections to the sensor transmitters 1 through N are shown in dotted line. As presently constructed, the programmer 6 comprises a hand-held device having five seven-segment alpha-numeric displays as well as an associated six row by four column keypad that, in turn, is coupled to a contained microprocessor and memory via the connector 8. The installer is thus able via the programmer 6 to separately enter unique system defined data into each of the integrated circuit transmitters contained within the UDI and sensor transmitters 1 through N.

Figure 2:
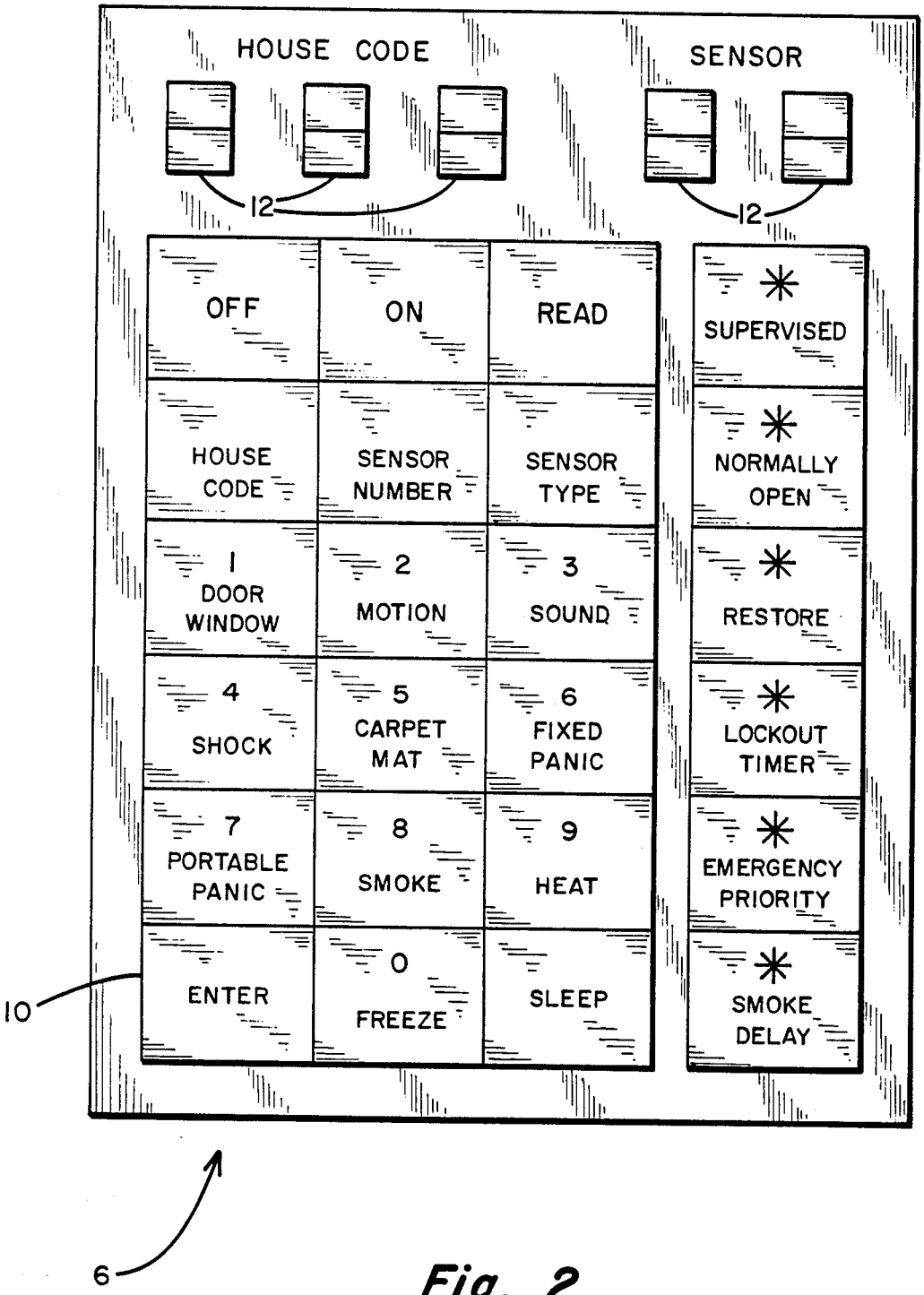
FIG. 2 shows a view of the keyboard of the hand-held programming unit.

In the latter regard, particular attention is directed to FIG. 2 and wherein a view is shown of the programmer keypad 10 and alpha-numeric display 12, along with the functions assigned to the various keys of the keypad 10. Without addressing the particular details of the circuitry contained within the programmer 6, it is to be appreciated that a Motorola model number MC146805F2 microprocessor is used and which is programmed to operate in relation to the source code listing appended hereto as Table 1 and from which it is believed that one of skill in the art would be able to readily implement such a programmer 6 without undue experimentation.

Without addressing the particular details of Table 1, mention will be made to each of the various programmable features and options that may be entered with the aid of the programmer 6 into the UDI and sensor transmitters 1 through N. Assuming first that a sensor transmitter is to be programmed, upon coupling the connector 8 to a desired sensor, the installer first presses the ON key and which causes the programmer 6 to display a HELLO. Thereafter, the installer enters a HOUSE CODE and which corresponds to a system identification number identifying that particular system and house or security system. The house code comprises a decimal number between 1 and 255 or alternatively eight bits of binary information. If an attempt is made to enter a number outside of the range, the display will indicate ERROR when the ENTER key is subsequently pressed.

Next, the installer enters the sensor number by first depressing the SENSOR NUMBER key and then entering appropriate numerical keys for a decimal number between 0 and 77. Thereafter, the SENSOR TYPE is entered by first depressing the SENSOR TYPE key and then the single numeric key corresponding to the type of sensor being programmed. It is be noted that during the programming of the UDI, the entry of a sensor type number is ignored. Upon next depressing the ENTER key, the programmed HOUSE CODE, SENSOR NUMBER and SENSOR TYPE are entered into the selected sensor. If an error is detected in the programmed entries, an ERROR is displayed and nothing is programmed. Alternatively, if a bad connection is detected, a FAIL message is displayed. Otherwise, once the sensor is programmed, a DONE message is displayed.

In a similar fashion, each sensor within the system is programmed, although for each successive sensor, the programmer need not re-enter the house code, sensor number and sensor type keys, because each of the entered numbers is saved, until reprogrammed with new data or the programmer 6 is powered down. Upon programming all of the system sensor and UDI transmitters, the installer presses the OFF key and which disables the programmer 6, losing any previously entered data.

During installation, should the installer desire to read a previously installed sensor transmitter to determine its contents, he/she need merely couple the connector 8 of the programmer 6 to the desired sensor transmitter, turn the programmer on and press the READ key. The programmer 6 in response thereto reads the sensor's programmed house code, sensor number and any other previously programmed pertinent information and which will be discussed hereinafter. Alternatively, for a new unprogrammed sensor, the programmer 6 will display a SLEEP message, indicating that the sensor has been programmed into a sleep mode. The sleep mode comprising a state where the sensor transmitter has been turned off to preserve battery life. Even though each sensor transmitter utilizes a lithium battery and which has a projected life of five years, the sleep mode further extends this life. The SLEEP function also allows the installer and/or homeowner to selectively disable desired ones of the sensors at selected times.

Because the programmer 6 is a battery operated device, it too contains a battery saving feature which operates to cause all of the segments of the display, except one, to go blank, if no keys are pressed during any given one-minute period. The display is restored, upon pressing any of the keys except ON or OFF; and if no keys are pressed during the next approximate ten-minute period, the programmer 6 turns itself off. As mentioned though, upon turning off, the programmer loses any previously programmed information, thus requiring re-programming.

In addition to providing for the foregoing address-type programming features, the present programmer 6 is also able to selectively program any of a number of options to essentially pre-condition each of the sensor transmitters to its associated transducer 1 through N. It is also to be appreciated that whereas heretofore most systems allowed the installer to enter a sensor address or identification number, this required the installer to selectively engage various DIP switches or other bi-state devices at the sensor. This tedious task is now done away with by merely allowing the installer to plug and unplug the connector 8. A further step forward enabled by the present system is the ability to program the mentioned options to pre-condition the sensors 1 through N. Heretofore, it was necessary to either include circuitry within the transducer itself or at the system controller 2 to accommodate transducer peculiarities. For example, a low battery condition at the transducer might cause it to operate in a way that the system detects an alarm. Similarly, floor mat and motion detectors might indicate redundant alarm conditions. The present invention, however, via the programmer 6 permits the installer to pre-condition each of the sensor transmitters 1 through N to its associated analog transducer and which programmable options will now be discussed.

In particular, the installer may select any of the six options provided in column 4 of the keypad 10 and which are SUPERVISED, NORMALLY OPEN, RESTORE, LOCKOUT TIMER, EMERGENCY PRIORITY or SMOKE DELAY. Depending too upon whether or not a specific SENSOR TYPE was previously programmed, ones of these options may have already been selected. That is, upon selecting SENSOR TYPE and depressing one of the numerical keys corresponding to a type of sensor (i.e. window, shock, mat etc.) ones of the options are selected under software control via the coding of Table 1. Alternatively, the individual options may be manually defined with additional options being selected to accommodate the system and sensor. In any case, each option is selected by selectively depressing desired ones of the option keys. Where more than one option is desired, the process is repeated.

Thereafter, each of the options causes the sensor or UDI transmitters to operate as follows: the SUPERVISED option causes the sensor transmitters, once approximately every 66 to 69 minutes, to transmit an OK signal to the system controller 2, identifying that the sensor is still operational. In this way, the system controller 2 is assured that the sensor is functioning and that its battery is not depleted.

The NORMALLY OPEN option allows the installer to program the initial switch condition or active state of the analog transducer and thereby also the inactive state, assuming a bi-state device. That is, for a reed switch, push button or magnetic switch, the switch contacts are typically open in their set condition and closed in their alarm condition. Similarly, for an electronic transducer, the output may be normally high for its set condition and at a logic low for an alarm condition. Via the normally opened option, the programmer is thus able to advise the system controller 2 what the initial detector state is. The RESTORE option, in turn, causes the sensor transmitter to transmit an OK signal to the system controller, upon the analog detector returning from an alarm state to its initial or normal state. Thus, upon programming the initial state of the transducer and selecting the RESTORE option, the system controller 2 is made aware of, for example, both the opening and closing of a door and each change of condition, as opposed to just an alarm condition.

The LOCKOUT TIMER option finds application with transducers such as motion detectors or floor mats which might be located in high traffic areas and where it is undesirable to have the sensor transmitter transmit each alarm condition with each passerby. The LOCKOUT TIMER option thus allows the installer for each associated sensor transmitter to enable a function whereby the first alarm transmission is allowed with the first passerby, but whereafter further transmissions are prevented until the transducer returns to its restored condition and stays in that condition for an established lockout time of at least approximately two to three minutes. If another alarm condition is detected before the lockout time has timed out, the alarm condition is not transmitted and the timer is restarted. Thus, during heavy traffic flow, the traffic pattern may be such as to continually re-set the lockout timer without ever allowing the re-setting of the restore condition and thus the transmission of a second alarm condition.

In a similar vein, an installer may also program a SMOKE DELAY for sensor transmitters coupled to smoke detectors and which causes the delay of any detected alarm condition for approximately five to ten seconds after the alarm occurs. Thus, should the battery be weak in the smoke detector and cause the detector to "chirp" and which normally indicates the weak battery condition to the user, the alarm system will prevent against false system alarms with each short chirp from the smoke detector.

Relative to emergency type alarm which require police and/or fire personnel, the programmer 6 also allows the installer to program each sensor transmitter with an emergency priority option. Specifically, the selection of this option at the sensor transmitter causes the transmission of more than a usual number of messages indicating the presence of an alarm condition. This option is thus selected typically only for sensors such as smoke detectors, panic buttons and the like.

One last selectable option is FREQUENCY SHIFT and which allows the installer to program the sensor transmitter to be compatible with the RF oscillator coupled thereto. As presently configured, such RF oscillators would comprise either a crystal or SAW controlled oscillator or alternatively an oscillator which has the ability of shifting its transmitting frequency.

Figure 1A:
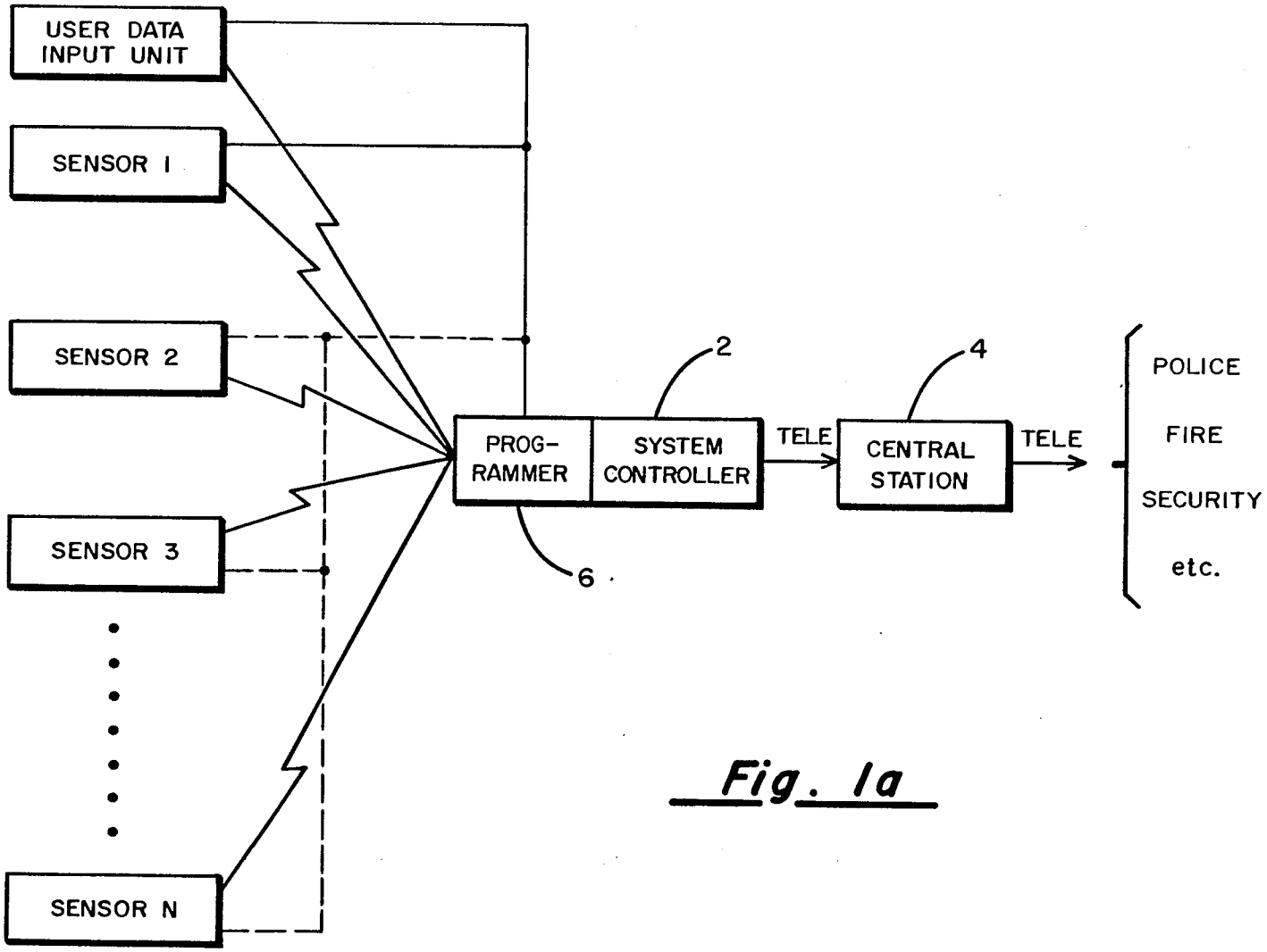
FIG. 1*a* shows an alternative system block diagram wherein the programmer is included in the system controller.

With reference again to the drawings, an alternative system arrangement to that of FIG. 1 is also shown in FIG. 1*a* and wherein the programmer 6 is included within the system controller 2. System programming is the same for this system as described for that of FIG. 1, except that now each sensor transmitter is programmed by coupling it to the controller 2 prior to installing it at the site.

Figure 3:
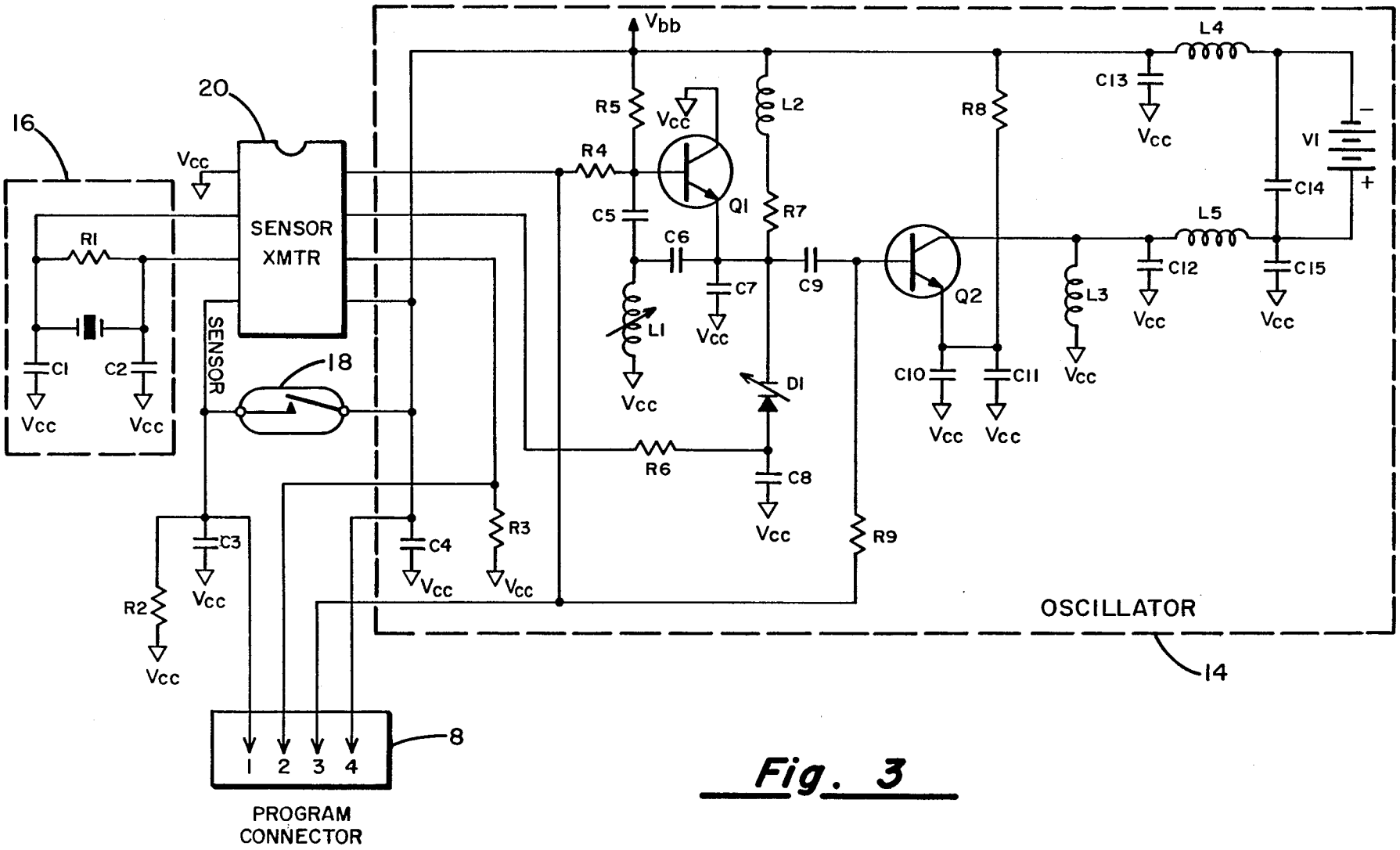
FIG. 3 shows a schematic diagram of the discrete circuitry of one of the system's plurality of sensor transmitters.
Figure 4:
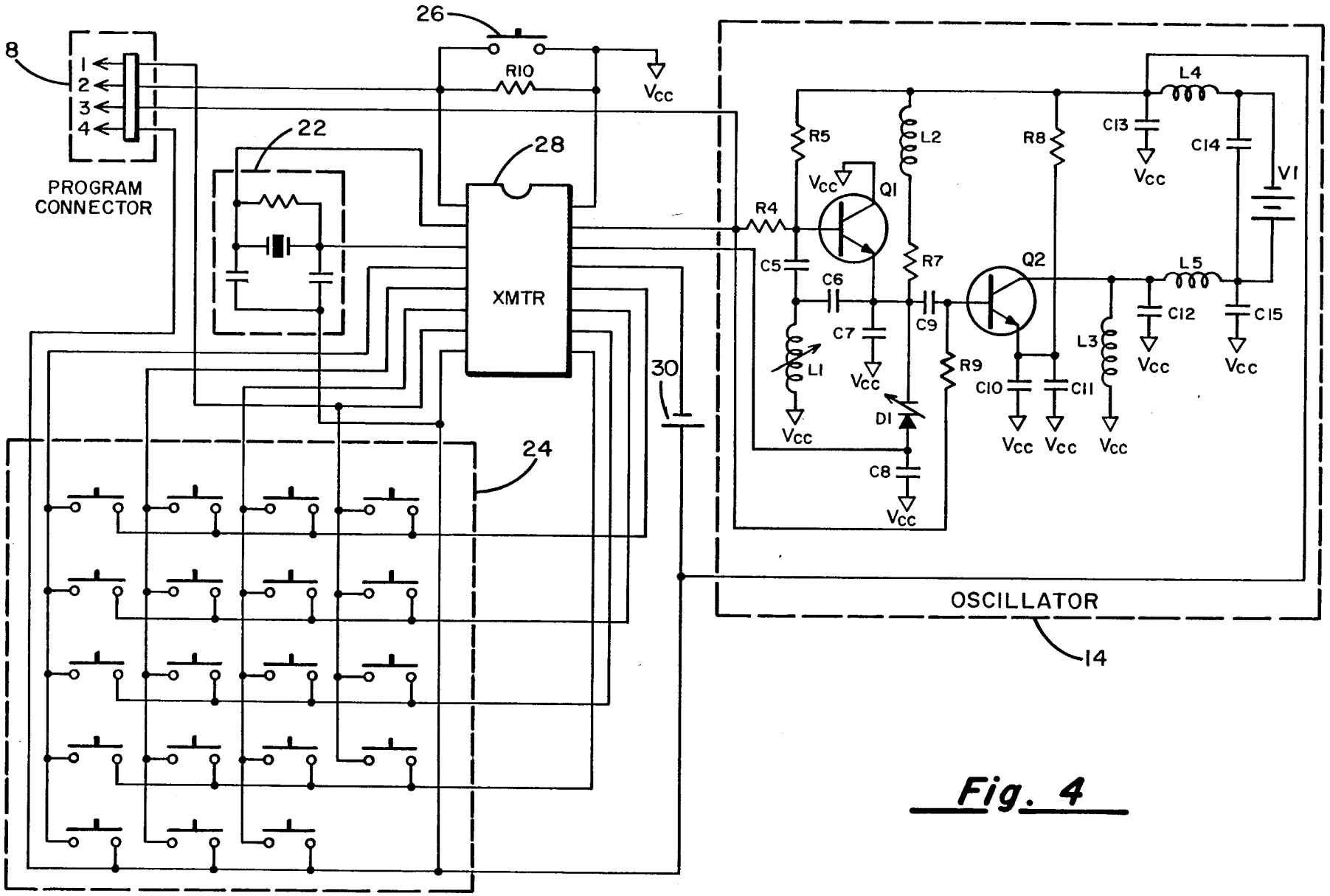
FIG. 4 shows a schematic diagram of the discrete circuitry of one of the system's user data input transmitters.

Turning next to FIGS. 3 and 4, schematic diagrams are respectively shown of the discrete circuitry comprising each of the sensor transmitters 1 through N and the UDI transmitters. Referring first to FIG. 3, a schematic is shown of one of the sensor transmitters and which is essentially comprised of the connector 8, a multi-frequency RF oscillator portion 14, a 32.768 Khz crystal clock 16, a reed switch 18 and an 8-pin CMOS custom integrated circuit pulse position encoding sensor transmitter 20. While the details of the sensor transmitter 20 will become more apparent hereinafter with respect to the discussion of FIG. 7, it essentially responds to the sensor and tamper inputs at pins 3 and 5, as well as to the programmed options entered via the programmer 6 at connector 8 and in particular the tamper pin, to turn the RF oscillator 14 on and off a pre-determined number of times, each transmission to transmit a series of identical messages to the system controller 2. Depending upon the type of transmission and the sensor number, the number of messages and the time between each message will be varied. While the intermessage timing will become more apparent hereinafter, the numbers of times a message is sent will vary with the cause of the transmission. In this regard, attention is directed to Table 2 below and wherein a tabular listing is shown of the various causes and the attendant numbers of messages transmitted.

TABLE 2

| Cause | Number of Messages |
|---|---|
| Alarm transition: fire or emergency sensors | 16 |
| Alarm transition: intrusion or auxiliary sensors | 8 |
| Restore transition (if selected) | 4 |
| Tamper transition | 4 |
| Supervisory (if selected) | 2 |

Thus, for any given cause, each message is transmitted a number of times so that the system controller 2 is assured of receiving the message.

If a transmission is in progress and another of the causes of transmission occurs, the second alarm condition will be transmitted with the first series of messages. The number of messages sent however will never be reduced but may be increased. For example, if an EMERGENCY alarm occurs, immediately followed by a TAMPER, at least 16 alarm messages will be sent and at least 3 of those messages will reflect the tamper condition. If too the RESTORE option is selected for any transmitting sensor, the last three messages of any transmission or series of transmissions will always indicate the latest sensor state, regardless of the number of times the sensor may have changed state during the transmission.

Relative to the message format, it is to be noted that with each message, a total of 20 bits of binary data are transmitted. The data being organized as a pulse position encoded message, with each message consisting of a four millisecond start or preamble pulse, followed by ten successive five millisecond data frames. Each data frame in turn contains a one millisecond data pulse and depending upon the position of which within the data frame, the system controller 2 decodes two bits of binary information. The time between messages is established to be from 300 to 600 milliseconds, the specific time being a function of the SENSOR NUMBER programmed into the sensor transmitter 20. It is also to be noted that the least significant bits of each message are transmitted first. In any case and with attention to Table 3 below, a pulse position encoding map is shown relative to the possible data pulses transmitted within each data frame.

TABLE 3

| Pulse position within data frame | Binary Data |
|---|---|
| 1st millisecond | No pulse |
| 2nd millisecond | Ø Ø |
| 3rd millisecond | Ø 1 |
| 4th millisecond | 1 1 |
| 5th millisecond | 1 Ø |

Lastly, it is to be noted that the transmitter control pin 2 of the sensor transmitter 20 controls the oscillator 14 frequency. Specifically and depending upon the output state at the pin 2 as determined by an internal register, the oscillator 14 will either be keyed ON five milliseconds before each message is sent and OFF at the end of each message or alternatively the oscillator 14 will shift frequency between two pre-determined frequencies with every other message. In this regard, it is to be appreciated that a multi-frequency oscillator 14 is used with the present sensor transmitters, although it is to be recalled that a crystal oscillator may be used in certain circumstances.

Turning attention next to Table 4 below, the meaning of the various bits contained at the various bit positions of each message are shown and some of which it will be recalled are established via the programmer 6.

TABLE 4

| Meaning | Bit Position |
|---|---|
| House Code | Ø–7 |
| Sensor Number | 8–13 |
| Transmitter Type (Sensor/UDI) | 14 |
| Tamper | 15 |
| Sensor (Current State) | 16 |
| Alarm Transition | 17 |
| Odd Parity (over even numbered bits) | 18 |
| Even Parity (over odd numbered bits) | 19 |

Specifically, the first fourteen bits of data contain the house code and sensor number, whereas the remaining six bits of data identify the transmitting unit as a sensor transmitter, whether a tamper condition has been detected, the current state of the sensor, whether an alarm transition (i.e. restore) has occurred and whether or not an error exists. It is also to be recalled that depending upon the selected pre-conditioning options established by the programmer 6, the sensor transmitter outputs appearing at the tamper, sensor current state and alarm transition bit positions will be conditioned thereby.

Turning attention next to FIG. 4, a schematic diagram is shown of the discrete circuitry of the user data input transmitter and which in large part is substantially similar to the sensor transmitter of FIG. 3. In particular, the UDI transmitter includes a program connector 8, a multi-frequency oscillator 14, a 32.768 Khz crystal clock 22, a keypad 24, an alternate function switch 26 and a 16 pin CMOS custom integrated circuit UDI transmitter 28. Also contained in the UDI transmitter is a 4 Khz audible feedback tone generator 30. Whereas the sensor transmitters 1 through N are individually coupled to separate transducers, the UDI transmitters are not and instead allow the homeowner or user of the security system to program various desired system configurations, functions or responses, depending upon the inputs selected at the keypad 24. At present, it is to be noted that the keypad inputs have not been defined, although each function is intended to comprise a one or two key input that is decodable by the UDI transmitter 28 and combined with various of the previously programmed data, before being transmitted via the oscillator 14 to the system controller 2.

While the details of the UDI transmissions will be discussed hereinafter, it is first to be noted that for each message and the non-emergency keys, as the UDI transmitter 28 decodes the selected keys, the data is latched, along with the house code, selected key numbers and stroke count data before being transmitted a pre-determined number of times to the system controller 2. Upon commencing the transmission, the tone generator 30 is also enabled for 60 milliseconds to confirm transmission to the user. If instead a key from the fifth row of the keypad 24 and which correspond to emergency keys is selected, as the message data is latched in the UDI transmitter 22, the tone generator 30 produces a pulsating audible feedback tone, comprising a 60 millisecond tone, a 360 millisecond pause, then six more tones of 120 milliseconds on and 120 milliseconds off. If the emergency key is released before the start of the second tone (i.e. before the expiration of 420 milliseconds) no further tones will be generated and no messages will be transmitted. Alternatively, if the key remains depressed beyond 420 milliseconds, the entered house code, key data, stroke count and parity error message are transmitted twelve times, regardless of how long the key is held thereafter. Thus, a time delay is provided when selecting emergency keys to assure that is what is intended and to disregard inadvertent depressions.

A further feature provided with the keypad 24 is the ability to effectively expand the possible number of key inputs, and thereby obtain multiple functions for each key. This expanded functionality is achieved by designating a separate key (i.e. switch 26) as an alternate function key and requiring the depression of this key while selecting the other function key.

Turning attention next to Table 5, a listing is shown of the makeup of the message data transmitted by each UDI transmitter relative to the related meaning and attendant bit position.

TABLE 5

| Meaning | Bit Position |
|---|---|
| House Code | Ø–7 |
| Key No. (3 bits/row and 2 bits/column) | 8–13 |
| Transmitter Type (Sensor/UDI) | 14 |
| Extra | 15 |
| Stroke Count | 16–17 |
| Odd Parity (over even numbered bits) | 18 |
| Even Parity (over odd numbered bits) | 19 |

In particular, it is to be noted that the transmissions from the UDI transmitter are essentially formatted the same as from each sensor transmitter and that each message comprises 20 bits of data. That is, the house code occupies bit position 0–7, a UDI transmitter identifier bit occupies bit position 14 and odd and even parity occupy bit positions 18 and 19, with bit position 15 being an extra. The new data comprises the row and column data transmitted at bit positions 8–13 and the stroke count data transmitted in bit positions 16 and 17. Other than this latter data and the differences in the numbers of transmissions for each message (i.e. two or twelve) the data is transmitted in the same pulse position encoded fashion as before, with the least significant data frame first. As before too, the two parity bits permit the detection of any single pulse shifted in time or the shifting in time of an entire message. The stroke counter and which comprises a two-bit counter that is incremented after each transmission and the contents of which is sent with each transmission allow the system controller 2 to distinguish between the transmission of repeated keys in a sequence.

Another anomaly of the UDI transmitter 28 is that in lieu of varying the time between messages, the time is fixed at 120 milliseconds. It is also to be appreciated that depending upon the frequency programmed by the programmer 6, the frequency of transmission can be varied. Specifically and for a first option, the oscillator 14 can be turned on for five milliseconds before each message and than off at the end of each message. The second option allows the oscillator 14 to shift frequencies with every other message.

Lastly and relative to the programming of the UDI transmitter 28, it essentially proceeds as that described for the sensor transmitter 20, although where 28 bits were programmed there, the UDI transmitter 28 only requires the programming of 22 bits. Of these and in order of progression, the least significant eight bits comprise the house code; the next seven bits are filler bits and are discarded upon leaving the programming mode; then comes a extra bit; two bits showing the current value of the stroke counter; next two unused bits that may be read back; next a bit defining a frequency shift condition; and, lastly a single bit defining whether or not a test mode is selected. Thus, where the sensor transmitters 20 provide for a number of pre-conditioning options, the UDI transmitters 28 are provided only with the selection of two programming options of frequency shift or test.

Figure 5:
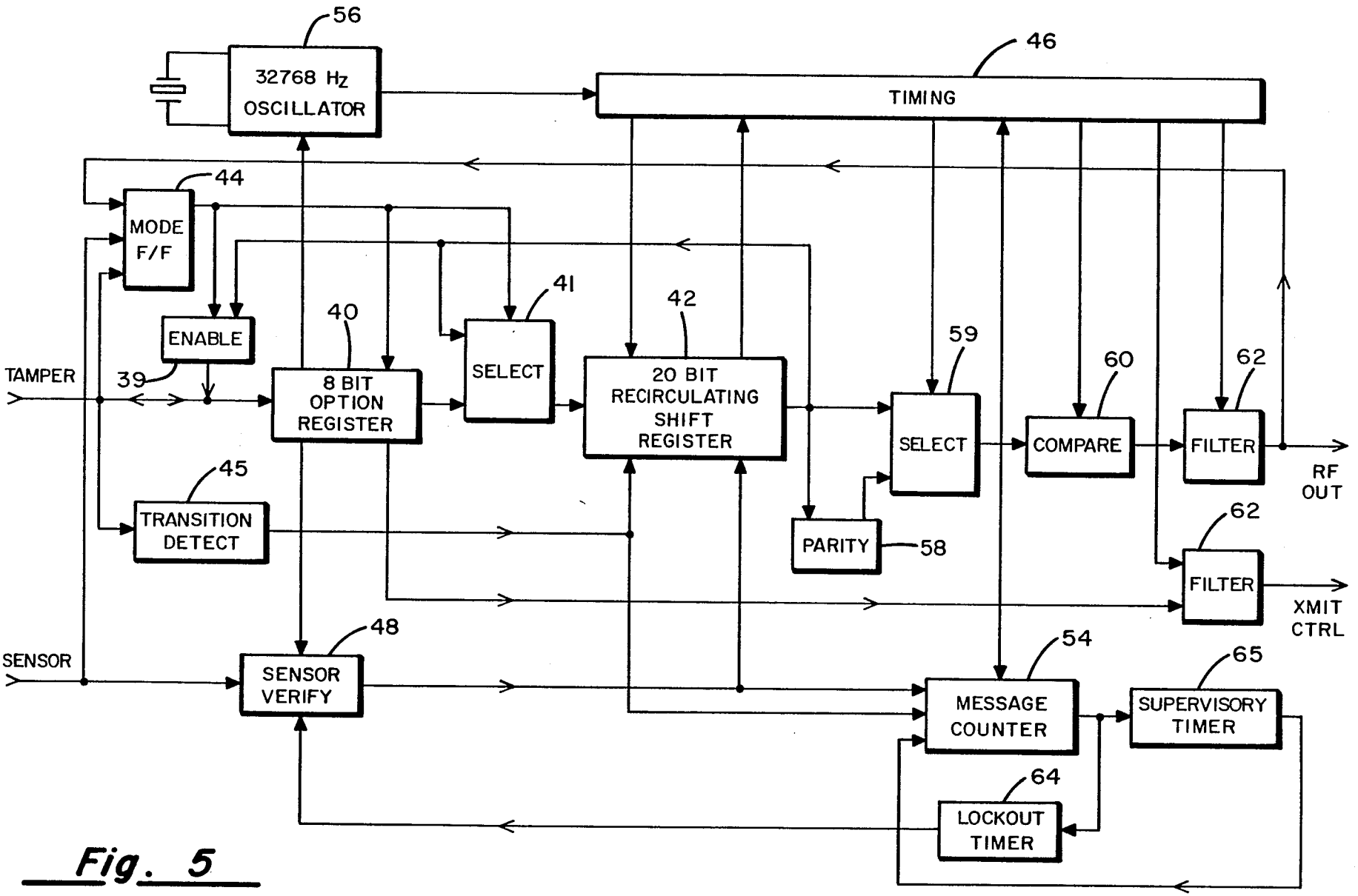
FIG. 5 shows a block diagram of the integrated circuitry of a sensor transmitter.
Figure 6:
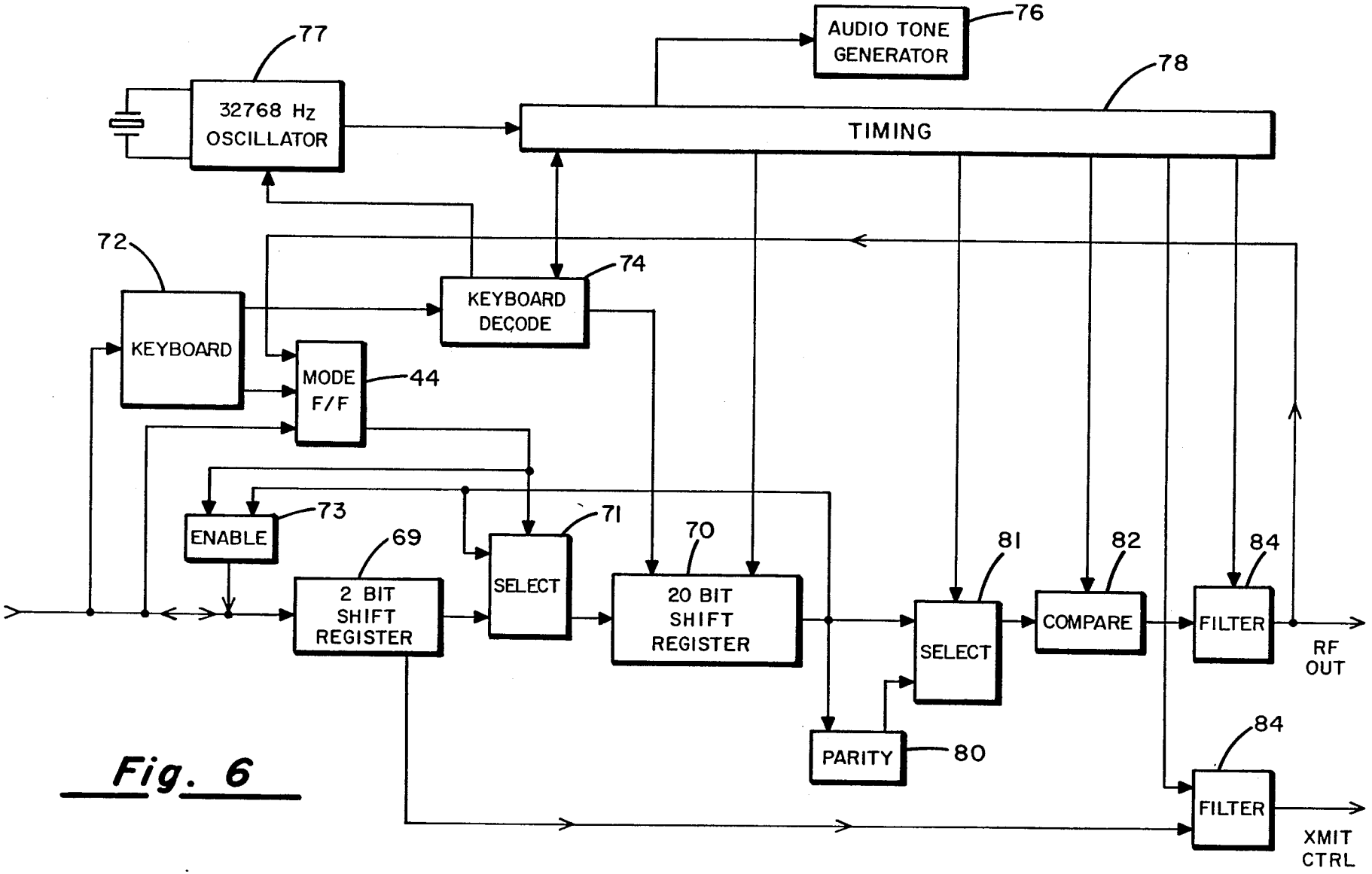
FIG. 6 shows a block diagram of the integrated circuitry of a user data input transmitter.
Figure 7A:
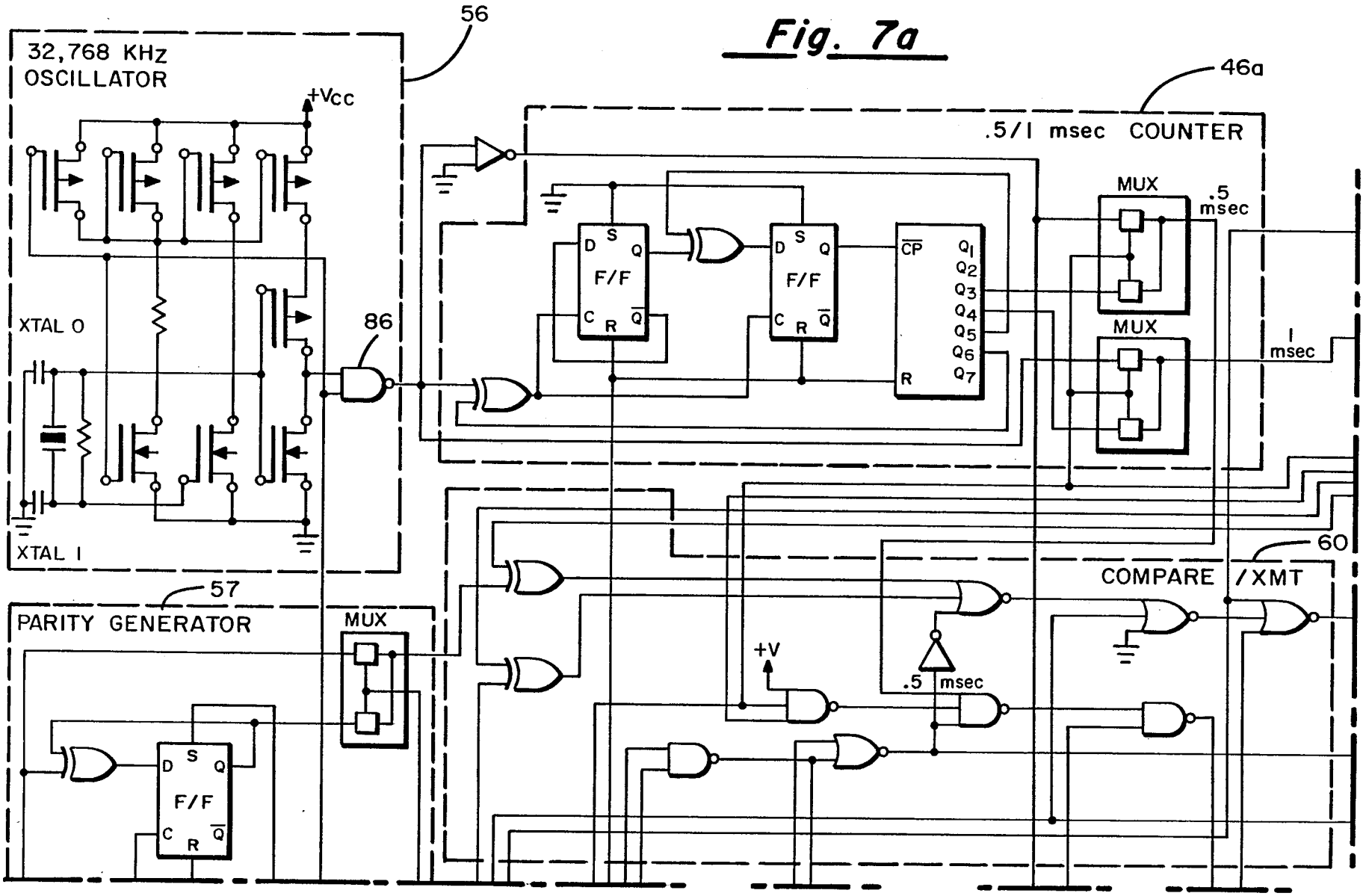
FIG. 7 shows the positional alignment of FIGS. 7*a* through 7*i* and which in turn show a detailed electrical schematic diagram of the sensor transmitter integrated circuit of FIG. 5.
Figure 7B:
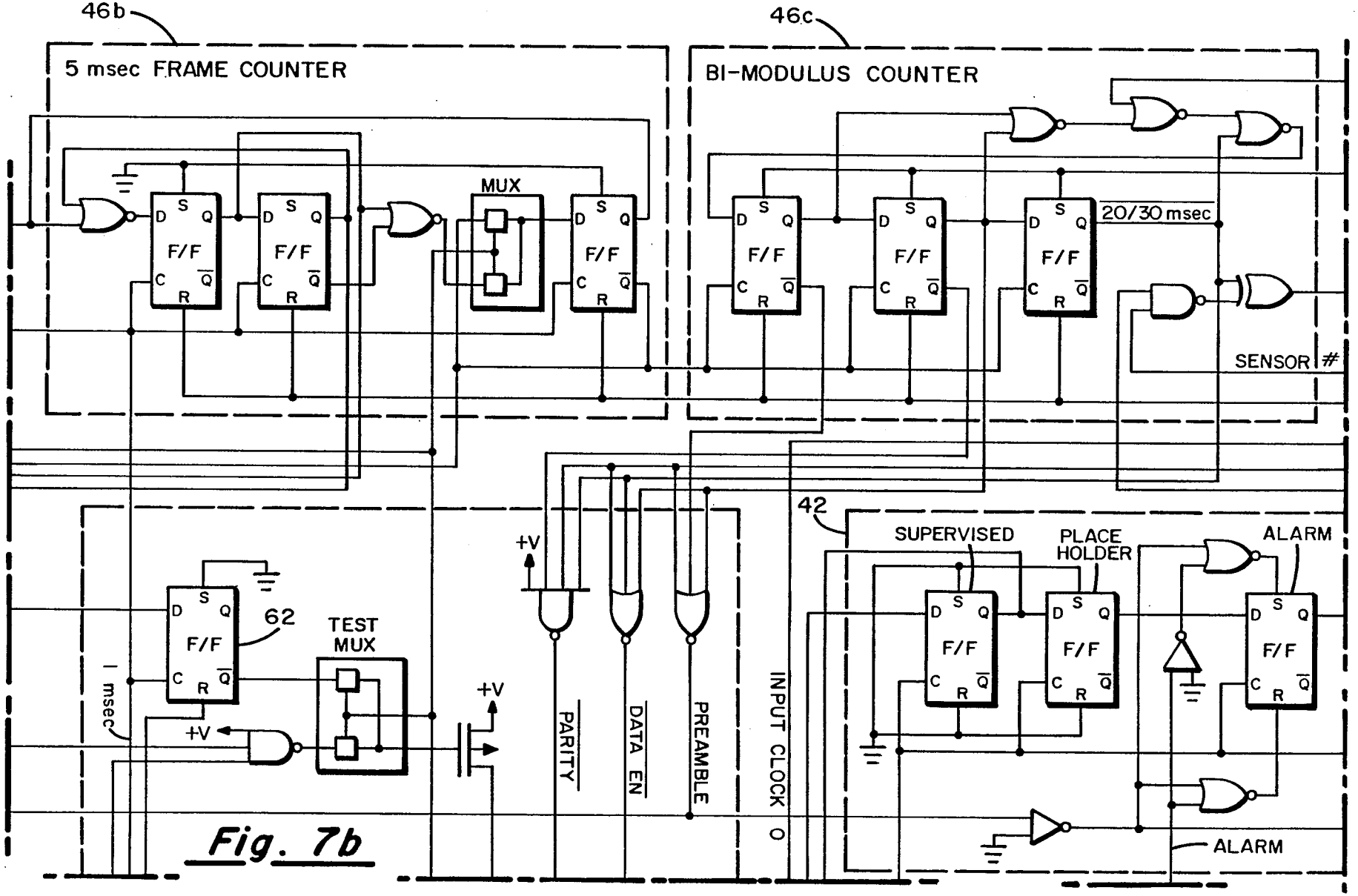
Figure 7C:
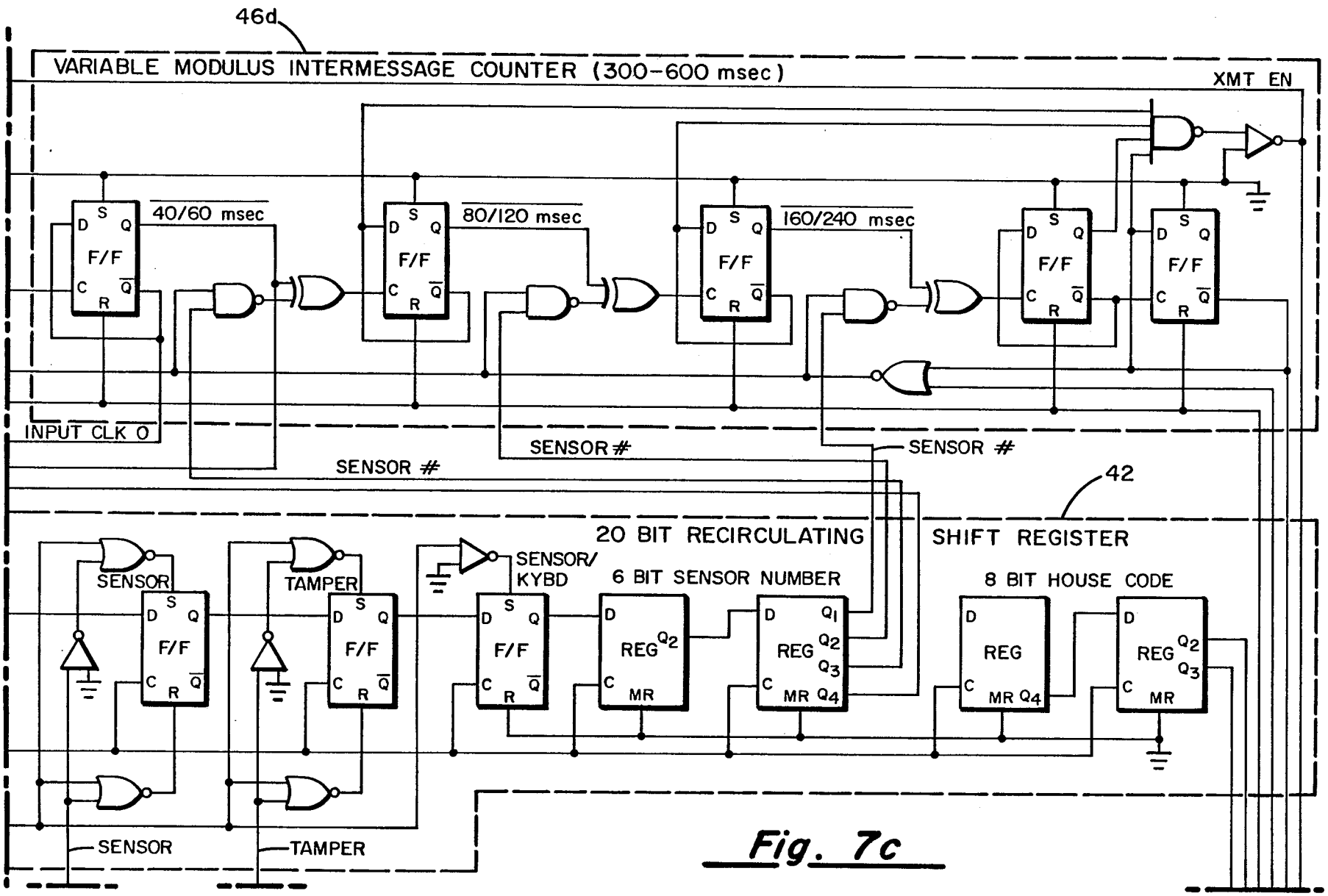
Figure 7D:
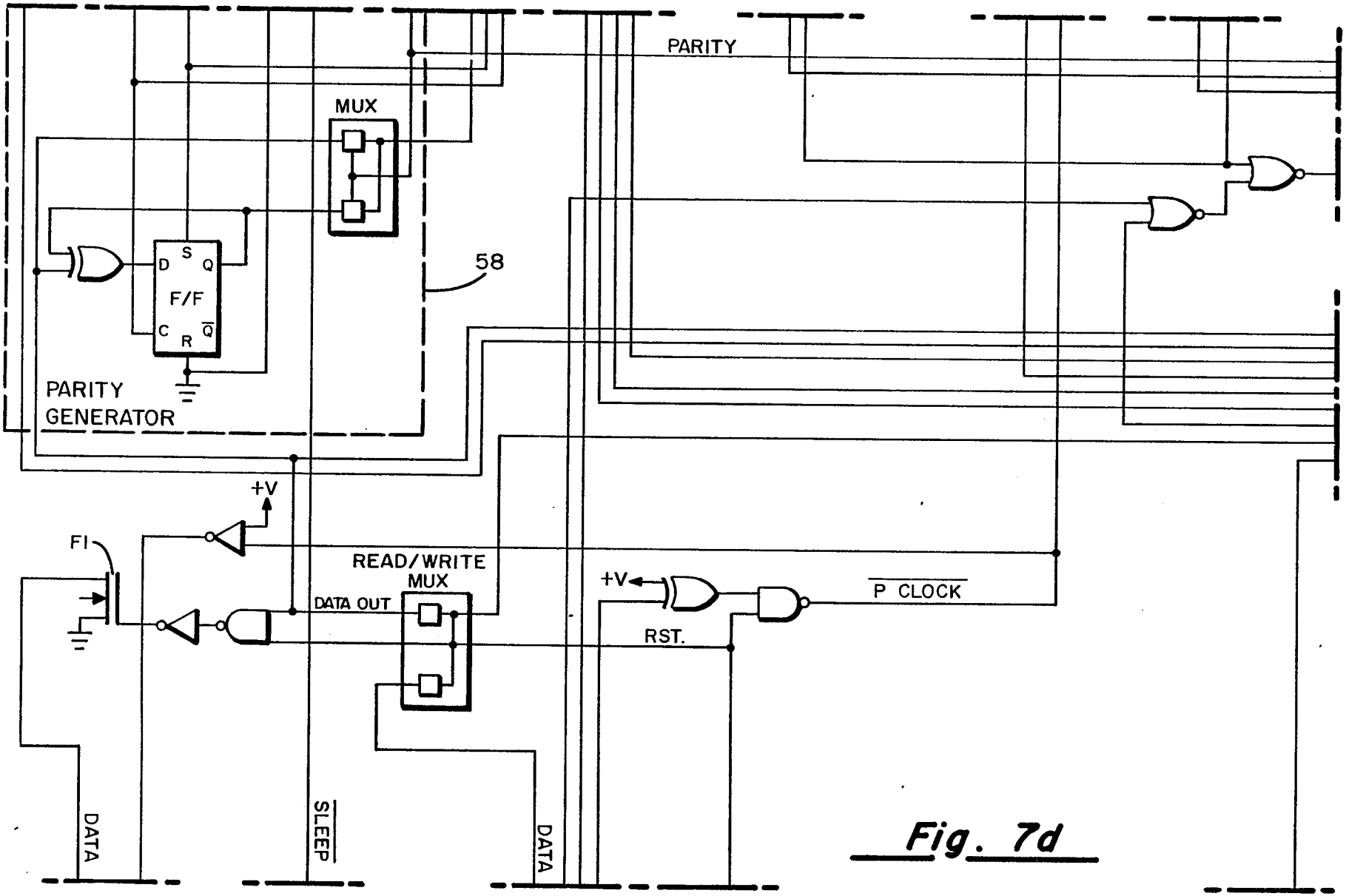
Figure 7E:
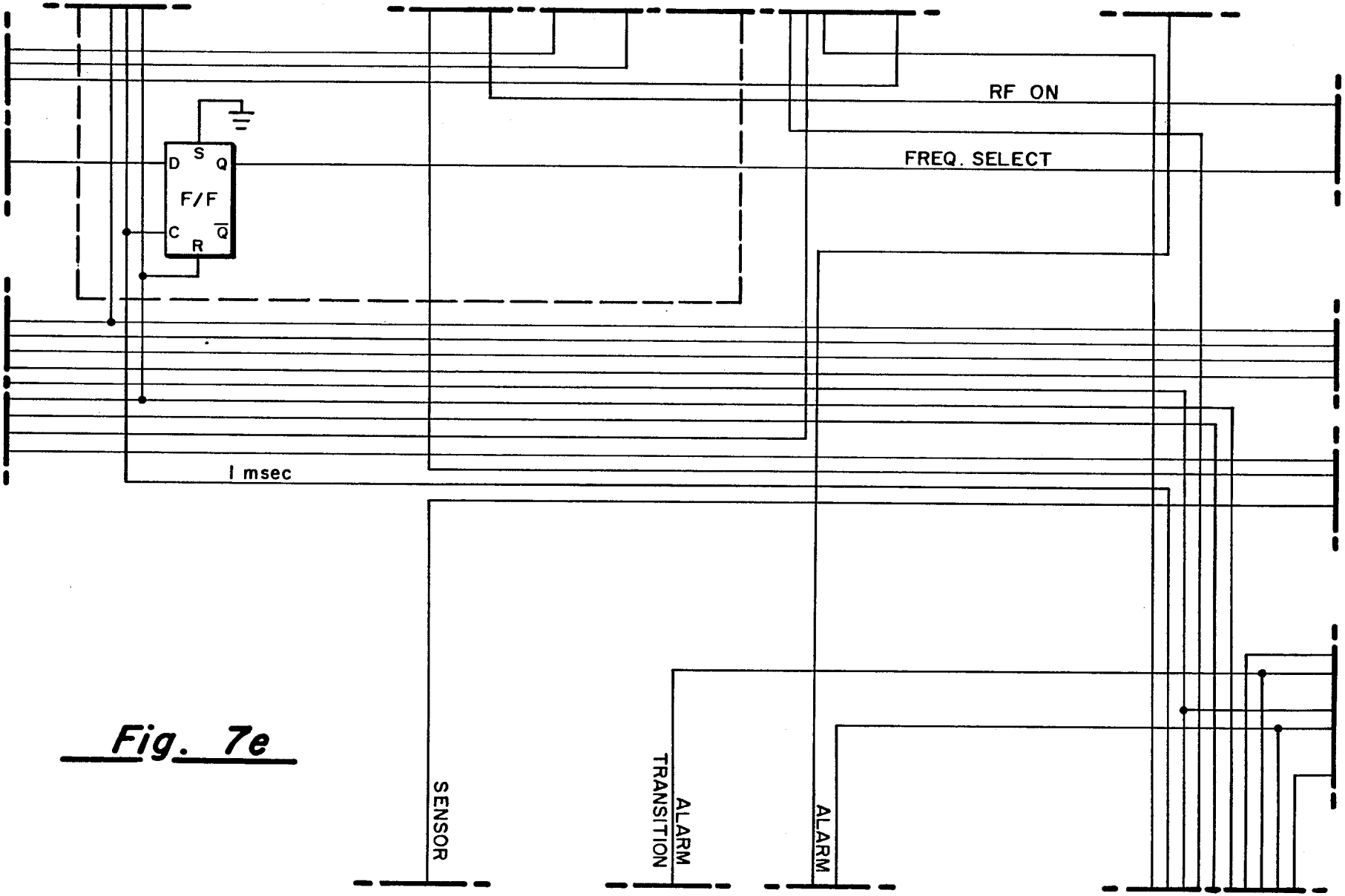
Figure 7F:
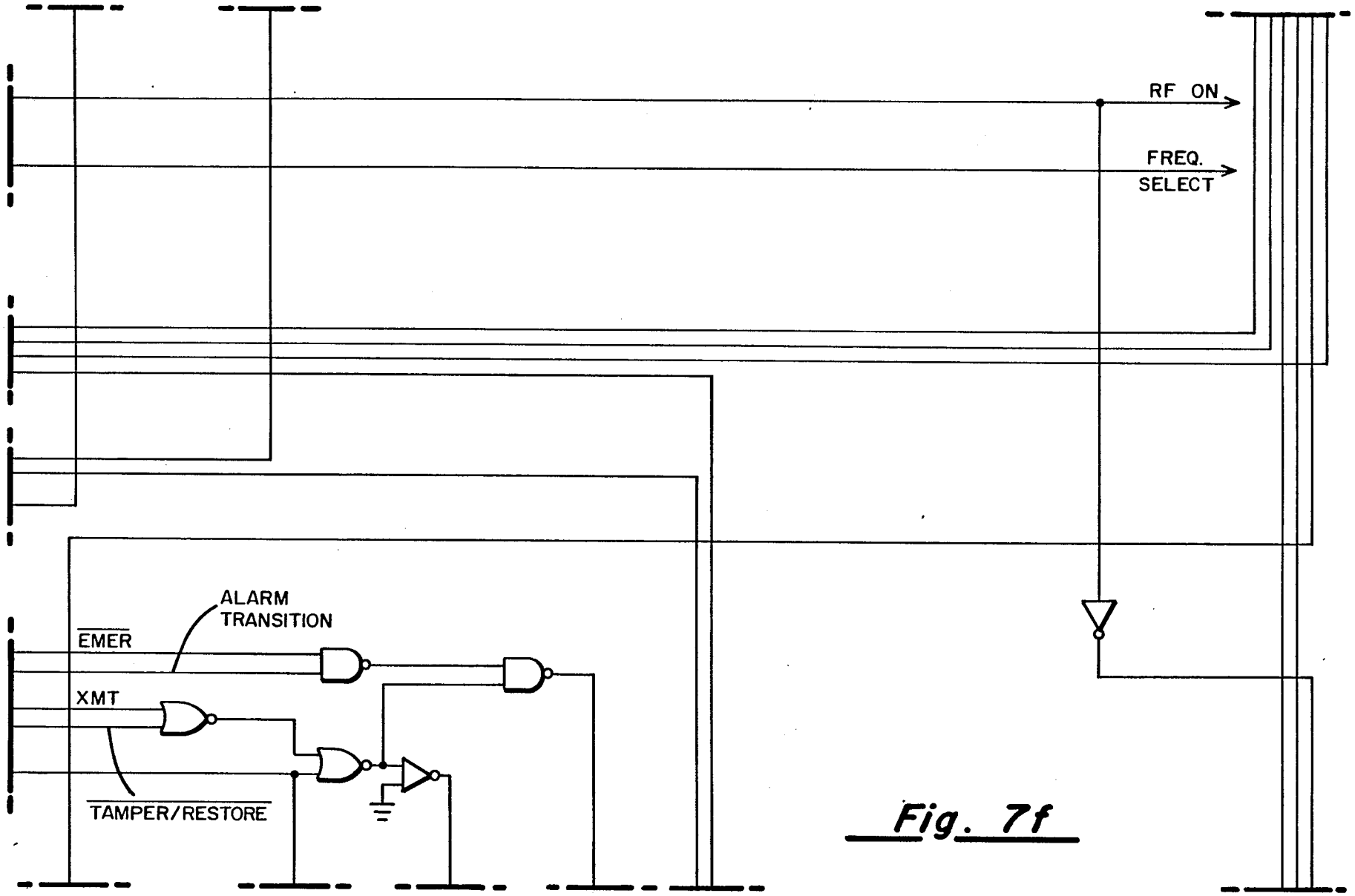
Figure 7G:
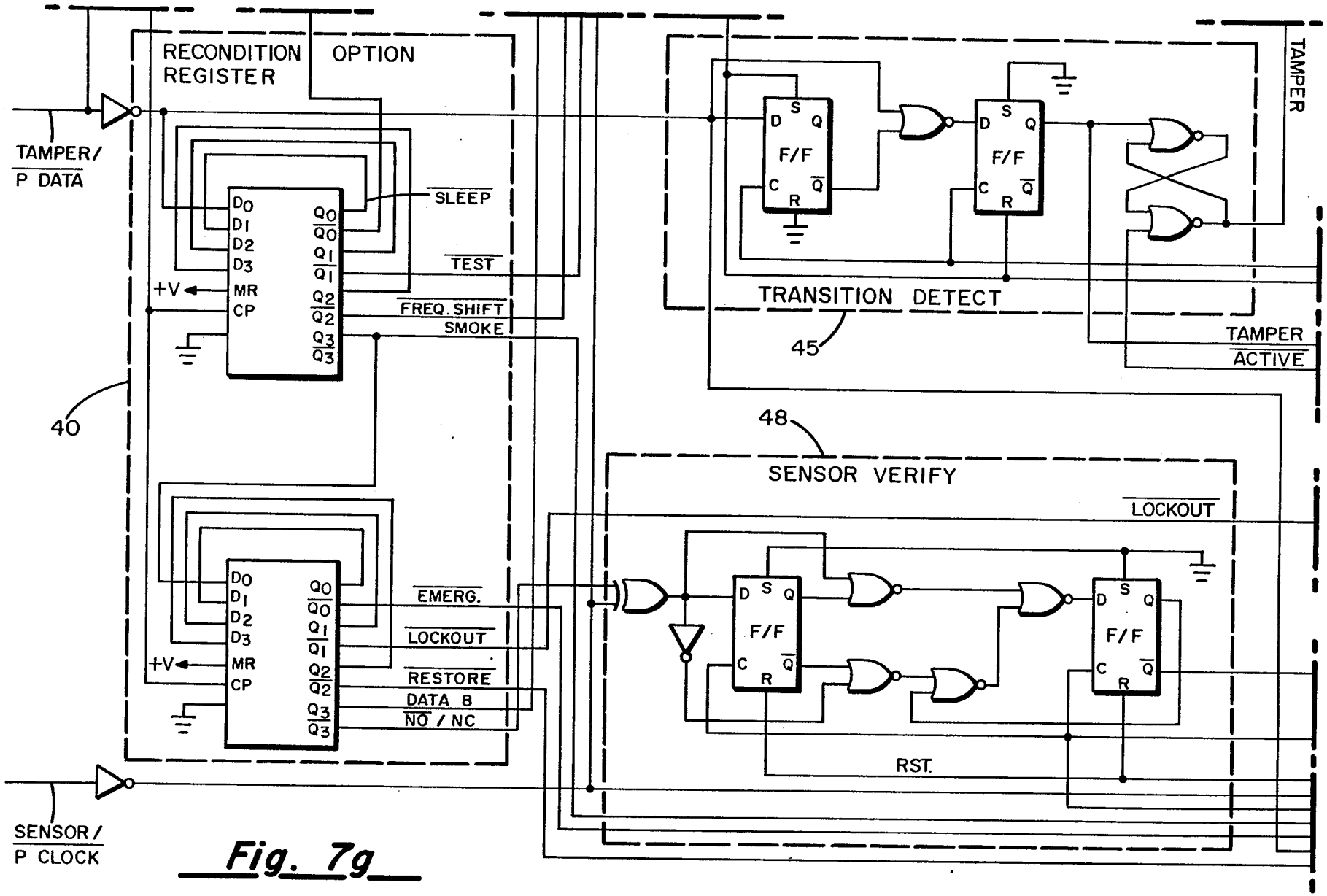
Figure 7H:
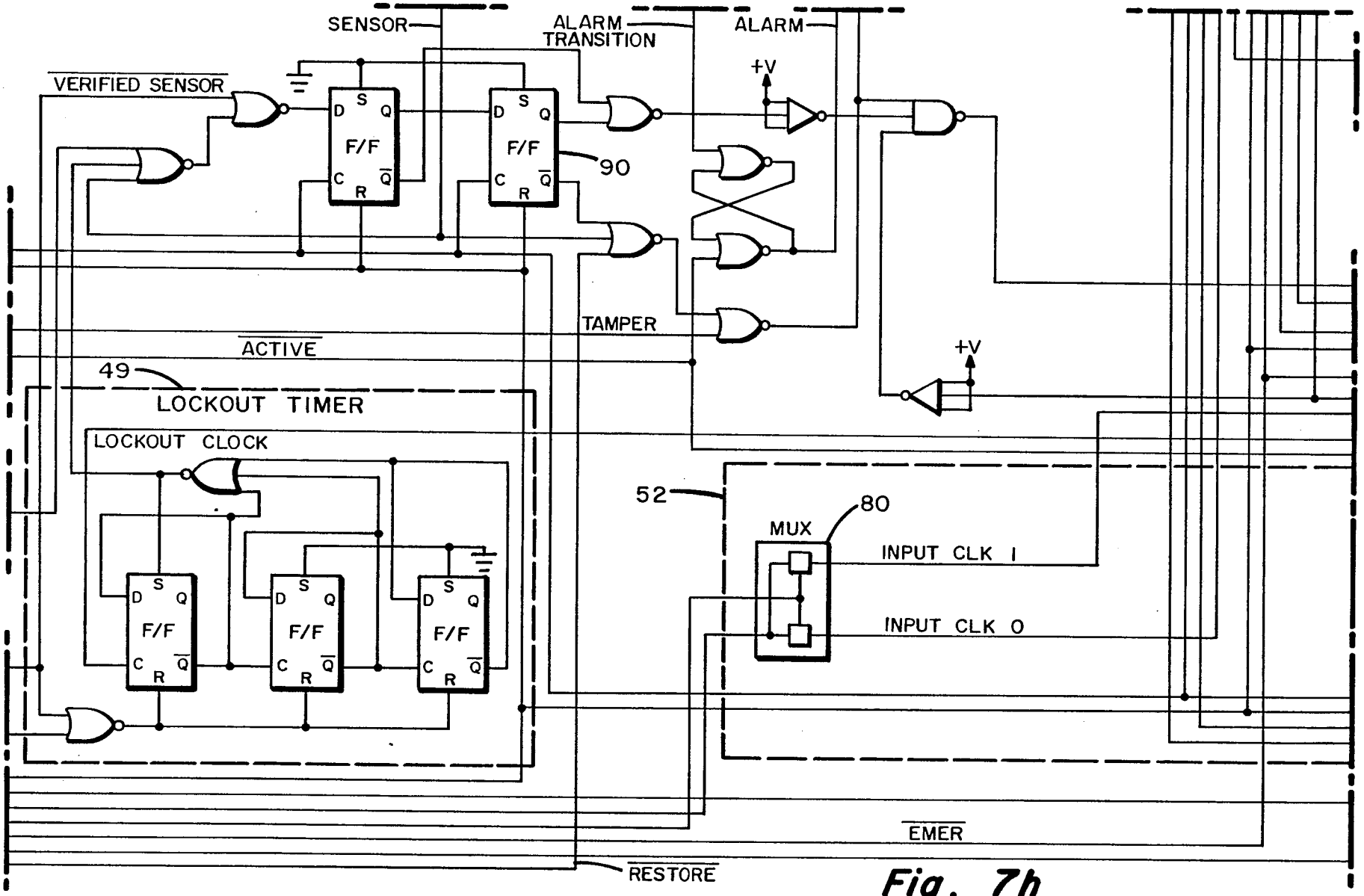
Figure 7I:
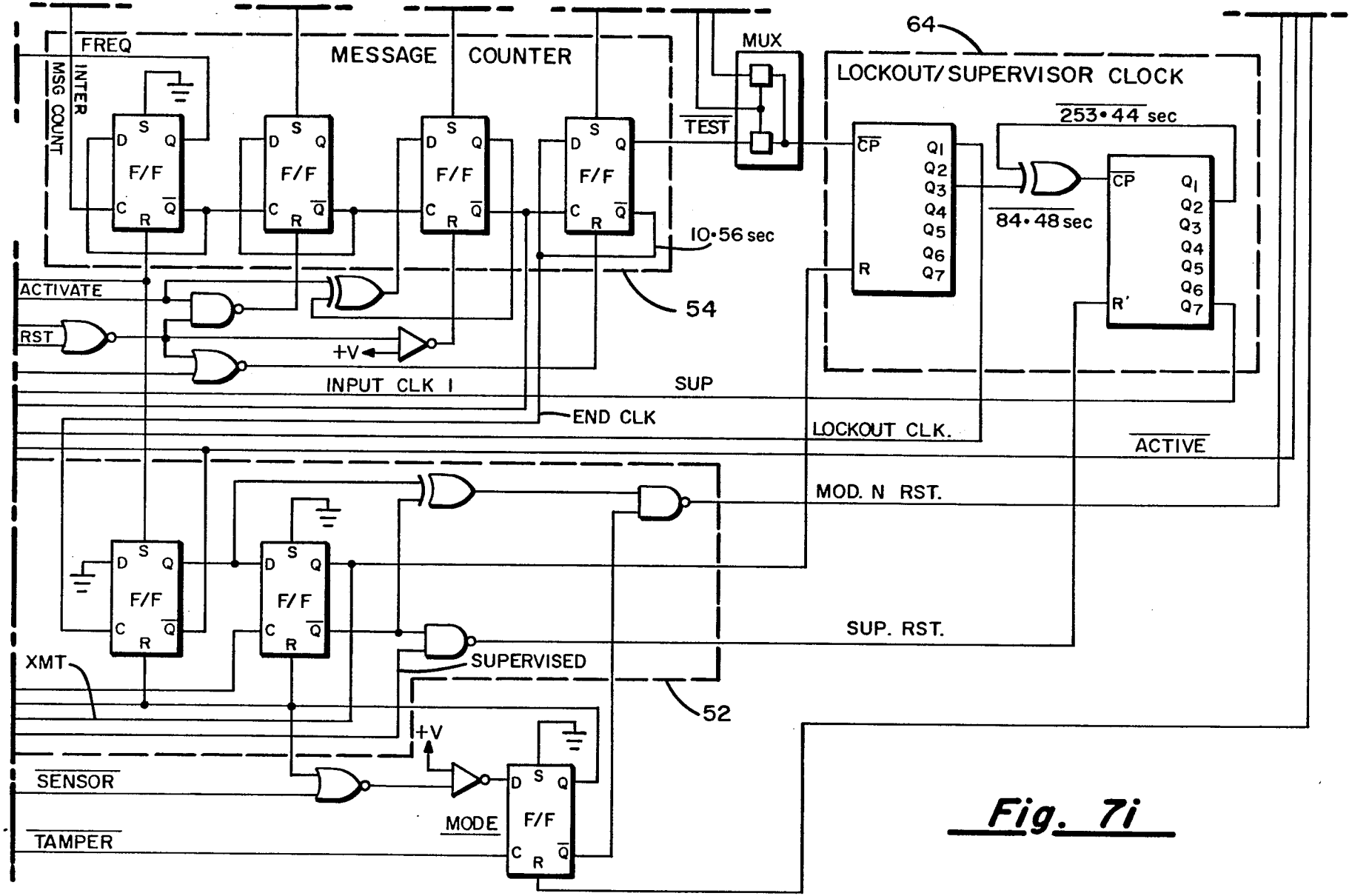

Turning attention next to FIGS. 5 and 6, the construction of the integrated circuit sensor transmitter 20 and the integrated circuit UDI transmitter 28 will be discussed relative to their respective block diagrams. Thereafter, a general discussion will be directed to the respective detailed schematic of each in FIGS. 7 and 8.

Referring therefore to FIG. 5, each integrated circuit sensor transmitters 20 is essentially comprised of a 28-bit re-circulating shift register and of which an 8 bit portion 40 stores, with the exception of the supervised option, the pre-conditioning data as entered by the programmer 6 when selecting the various mentioned programmed options. A second portion 42 contains the 20 bits of data that is transmitted with each message and all of which data is stored in a re-circulating fashion such that it can be transmitted at appropriate times and/or interrogated by the programmer 6 via the tamper and sensor input terminals. Various other circuitry included with each sensor transmitter comprises the inter/intra-message timing circuitry 46, sensor verify circuitry 48, condition decode circuitry 52, message counter circuitry 54; as well as the message transmission circuitry, including parity generator 58, compare transmit circuitry 60 and filter 62. Still other provided circuitry will be discussed below relative to the normal operation of the transmitter 28.

Considering now briefly the operation of the sensor transmitter 28 during programming, it is to be noted that the tamper input becomes both a serial data input and output terminal. As such and upon connecting the programmer 6 via the connector 8 to the sensor, a mode flip-flop 44 is caused to reset the inter/intra-message timer 46 and condition the other circuitry to receive the programming data. Upon thereafter engaging the enter key of the programmer 6, the data enters at the tamper input and is fed through the 8-bit register 40 to the 20-bit register 42. Thus, 28 bits of data are programmed and which bits are read and programmed in order from the least significant to most significant bit position. In particular, this data comprises the 8 bit house code, the 6 bit sensor number, 4 bits which are discarded upon leaving the program mode, one bit which is ignored but which can be read back, one supervised bit, one NO/NC bit, one restore bit, one lockout bit, one emergency bit, one smoke bit, one frequency shift bit, one test bit and one sleep bit.

Otherwise, during all other modes, data is received at the sensor input. It is possible though, during a tamper condition to receive data at the tamper input, and which might occur upon attempting to break into the sensor transmitter 20 and which would induce the closing of the reed switch 18. The sensor transmitter 20, in turn, would verify the transition of the tamper input at the transition detect circuitry 45 before storing the tamper bit and at the same time induce the transmitter 20 to transmit four messages indicating the tamper transition.

Assuming though that sensor data is received, it is first verified by the sensor verification circuitry 48 relative to the programmed NO/NC condition of the transducer before being logically processed relative to any programmed options. Depending then on whether or not other options are programmed, such as SUPERVISED, LOCKOUT, RESTORE, SMOKE, EMERGENCY and FREQUENCY SHIFT, the circuitry latches the sensed data and transmits a related message an appropriate number of times, while continuing to monitor the sensor input for the detection of a restored condition and upon the occurrence of which, data is entered at the alarm transition bit position. Assuming the RESTORE condition is programmed, with the setting of the alarm transition bit, the condition decode circuitry 52 and message counter 54 thereafter cause the transmission of four restore messages. Otherwise, the loading of the sensor bit and confirmation of a non-emergency condition causes the message counter 54 to induce the transmission of eight sensor transition messages. Alternatively, if the sensed input occurs at a sensor transmitter 20 programmed with the emergency option, the condition decode circuitry 52 upon detecting the sensor input causes the message counter 54 to induce the transmission of sixteen messages.

Still further, if either the LOCKOUT or SMOKE options have been selected, then the verified input is respectively either delayed five to ten seconds or alternatively logically processed relative to the lockout timer 49 at the condition decode circuitry 52 before being latched and transmitted. During the latter LOCKOUT condition, it is to be recalled too that the first alarm transition will be passed but that subsequent alarms will not, until the lockout timer has timed out.

Turning attention to the crystal oscillator 56, it is to be noted that, except when the sleep option is programmed, the oscillator 56 runs continuously with a current consumption of only microamps. The latter option serving to disconnect the oscillator 56 from the remaining circuitry. Otherwise, the oscillator 56 is coupled to the inter/intra-message timer circuitry 46 and which includes the necessary circuitry for clocking the data through the shift registers 40 and 42, pulse position encoding the messages at the clock times of 0.5, 1 and 5 milliseconds as well as establishing a variable inter-message time, dependent upon the programmed sensor number and the least significant four bits of which are coupled to a variable modulus counter in the circuitry 46. It is to be recalled that this inter-message time corresponds to a selected time between 300 and 600 milliseconds. The specific amount of inter-message time for each transmitter depending upon the decoding of the four sensor bits and which determines a particular multiple of 30 milliseconds. Thus, the inter-message time period for each sensor transmitter will vary from the others by a multiple of 30 milliseconds between the 300 and 600 millisecond range.

In any case, as each message is transmitted, it is first clocked through the parity circuitry 58, where the parity of the odd and even bit positions is monitored. Thence each message is passed through the compare transmit circuitry 60, where each message is organized into a series of 5 msec frames, with each data frame containing the combined binary information of two register stages combined into a single 1 millisecond pulse. The particular position of each pulse depending upon the data as per Table 3, infra. Next, each message is filtered at the filter 62 and coupled to the RF output pin 1 and the oscillator 14. Depending too upon whether the frequency shift option is selected, an appropriate output is coupled to the output pin 2.

Lastly, it is to be noted that if the supervisory option had been programmed, upon the timing out of a supervisory timer 64, a two message supervisory transmission would be enabled via the message counter 54.

Turning attention next to FIG. 6, a generalized block diagram is shown of the UDI transmitter integrated circuit 28. This integrated circuit, it is to be recalled, is contained in each of the UDI transmitters coupled to the system controller 2. Generally, each integrated circuit contains a 22-bit re-circulating shift register 70 and attendant control circuitry. The various register stages are organized in a fashion similar to that for the sensor transmitter 20 and are allotted in the following fashion: the eight bit house code, seven filler bits which are discarded when leaving the program mode, one extra bit, two stroke counter bits, two bits which are ignored except during reading, one frequency shift bit and one test bit. These latter two bits also being deleted from transmissions to the system controller 2.

During programming, it is to be recalled that, as with the sensor transmitters 20, data can be written into and read out of the shift register 70 via the connector 8, upon initiating an enter or read key at the programmer 6. Otherwise, the UDI transmitter 28 operates only to transmit messages containing the data entered at its associated keypad 72.

In this latter regard, it is to be recalled that a five row by four column switch matrix is provided by way of the keyboard 72 and the keys of which can be used to enter not only numerical data, but also function data. Associated with the keyboard 72 is keyboard decode circuitry 74 and which operates to monitor the keyboard 72 to detect key depressions. Upon detecting a key depression, an 8 millisecond debounce period is provided and after the timing out of which a counter is enabled to selectively access each of the keyboard rows until a match is detected between the column containing the selected key and the selected row. At that time, the counter is stopped and the row and column inputs are latched into the shift register 70 and used to identify which key was depressed. Along with the key data, the state of a stroke counter, used to detect multiple depressions of the same key, the house code and the other data mentioned in Table 5 are transmitted twice, while a 4 Khz tone sounds for 60 milliseconds. In a similar fashion, as each key input is latched, it is transmitted to the system controller 2. If an emergency key is depressed, it is almost immediately latched, but is not transmitted, until the key has been depressed for at least 420 milliseconds as determined by the inter/intra-message timer circuitry 78. Thereafter, transmission begins and continues, regardless of whether or not the key is released. The 420 millisecond timing period being indicated via the audio-tone generator 76 and the mentioned transmission of six successive tones of 120 msec ON and 120 msec OFF after the first 60 msec tone and a 360 msec delay.

Timing for the attendant keyboard decoding and message transmissions 28 is provided via a 32.768 Khz crystal oscillator 77 and which, as mentioned, automatically shuts down or switches to a battery-saving mode, except during data entry. The oscillator 77, in turn, is coupled to the inter and intra-message timing circuitry 78 and which again generally comprises a plurality of counters for providing the necessary 0.5 msec, 1 msec and 5 msec timing signals necessary to assure the proper pulse position encoded message format. Other counters provide a 60 msec signal used during the generation of the audible feedback tones as well as a message counter for keeping track of the numbers of messages transmitted and the 360 msec depression delay required when selecting emergency functions. In this regard, it is to be recalled that two messages are transmitted for each non-emergency key depression, whereas twelve messages are transmitted for each emergency key depression.

As the data is transmitted, it again passes through a parity generator 80, but the output of which is again not selected until the last frame of the message. Otherwise, the data passes through the parity generator 80 to the associated compare and transmit circuitry 82 which insures that the data is properly aligned per the pulse position encoding schema. Lastly, the data is filtered via the filter circuitry 84, prior to being coupled to terminal 15 and the oscillator circuitry 14. The selected frequency shift option at the same time being coupled to the transmit control terminal 14.

Turning attention lastly to FIGS. 7 and 8, detailed schematic diagrams are shown of the block diagram circuitry of FIGS. 5 and 6. Relative to FIG. 7, it is to be noted that it is comprised of FIG. *7a* through and inclusive of FIG. *7i*, and which figures align with one another as shown in FIG. 7. Before referring to some of the details of FIG. 7, it is to be further appreciated that the detailed circuitry has generally been segmented to correspond with that disclosed in the block diagram of FIG. 5. Similarly, FIG. 8 shows the alignment of FIGS. 8*a* through 8*i* and which disclose the detailed schematic of the circuitry generally shown in the block diagram of FIG. 6. The various circuitry corresponding with the functional blocks of FIGS. 7 and 8 also being generally shown in dashed line FIGS. *7a* through *7i* and 8*a* through 8*i*.

Referring first to FIG. 7, it is to be noted that the inter/intra-message timer 46 essentially comprises a number of counters each having a different modulus and whereby the necessary transmitter timing signals are achieved. In particular, a first counter portion 46*a* shown in FIG. *7a* produces a 0.5 msec and a 1.0 msec output. The 0.5 msec clock being used among other things during the clocking of data into each data pulse and the 1.0 msec clock to define each data pulse. A second counter portion 46*b* shown in FIG. *7b* produces a 5 msec clock output that is used to establish the duration of each data frame. The next counter portion 46*c* operates at two different moduli at different times to produce clock outputs used to establish the appropriate timing for the parity and preamble portions of each message as well as to establish the timing between messages.

Inter-message timing is further facilitated via the variable modulus inter-message counter portion 46*d* shown in FIG. *7c* and the stages of which, along with a portion of the counter 46*c* previously mentioned, are responsive to the least significant four bits of the number assigned to each sensor to appropriately operate the counter at a uniquely related modulus and thereby obtain an inter-message time, functionally related to the sensor number. In particular, the counter output will correspond to a time between 300 and 600 msec. The particular output varying in increments of 30 msec, depending upon the sensor number. Thus, for example, for Sensor No. 1, the output might be 330 msec between each message and for Sensor No. 2, 360 msec between messages.

Directing attention next to FIG. *7g*, the tamper and sensor inputs are shown relative to the 8 bit register portion 40 of the 28 bit total re-circulating shift register and wherein the various pre-conditioning codes are stored, with the exception of the supervisor option and which is stored in the 20-bit portion of the re-circulating shift register 42 shown in FIGS. *7b* and *7c*. The tamper input, it is to be recalled, is used to receive in addition to a tamper condition from the reed switch 18, data from the programmer 6 or alternatively the data stored in the sensor transmitter 20 as it is read by the programmer 6. In the latter case, the data is coupled to the programmer 6 via the FET F1 in FIG. *7d*. Otherwise, as an input is received it is coupled to the transition or tamper detect circuitry 45 in FIG. *7g* and whereat the change in state is confirmed and coupled to the re-circulating shift register portion 42 by setting the register stage defining the tamper bit. At the same time, a control signal is produced and coupled to the message counter 54 in FIG. *7i* to cause the counter to induce a four-message transmission. The counters of the inter/intra-message timer 46 are re-set preparatory to formatting and transmitting the pulse position encoded messages. The transmit compare circuitry 60 is also enabled and, in particular, the 0.5 msec shift clock signal is coupled to each of the register stages and which in turn clocks the data through the shift register portions 40 and 42 and into the parity circuitry 58.

If instead a sensor input is detected, the input is verified at the sensor verify circuitry 48 in FIG. *7g* relative to the programmed NO/NC option stored in the precondition option register 40 to detect a change in the sensor input condition. The verified sensor condition is subsequently coupled to the sensor data stage of the shift register 42 and from whence it is transmitted along with the various other data stored therein to the system controller 2. If as the sensor input was received, the smoke option had been programmed within the precondition option register 40, a corresponding control signal would have been coupled to a clock signal selecting multiplexer 80 in FIG. *7h* and used to select the input clock 1 to clock the sensor verify circuitry at a slower rate than that normally provided via the input clock 0. In this fashion, a verified sensor output would not occur until the expiration of 5 to 10 seconds and after which, if the sensor input still existed, the verified sensor signal would be coupled to the register 42.

Alternatively, if the LOCKOUT option were programmed and although the first detected sensor input would be coupled to the register 42; subsequently sensed inputs would not be passed, unless the lockout timer 49 in FIG. *7h* had timed out and allowed the sensor input to return to its restored condition. In particular, even though the sensor input may be changing, the control circuitry logically processes the changing input with the programmed LOCKOUT option and the output of the lockout timer 49 to prevent the setting of the sensor data bit and the subsequent transmission of an alarm message, until the lockout timer 49 has reset. In passing, it is be noted that the lockout timer 49 is clocked via a clock signal from the lockout/supervisor clock 64 in FIG. *7i*.

Along with the sensor input condition, it is to be recalled that the sensor transmitter 20 is capable of transmitting a message corresponding to the restoration of the sensor to its initial condition. The verified sensor condition is therefore logically monitored for a change in state via a flip-flop 90 and other logic circuitry in FIG. *7h* and upon the occurrence of which event the alarm transition stage of the register 42 is set, and after which an appropriate number of messages are transmitted, assuming the RESTORE option was selected.

Message transmissions may also be induced via the selection of the SUPERVISED option and which occurs upon setting the supervised stage of the register 42 in FIG. *7b*. Assuming this stage has been appropriately set, at the end of each message transmission, the supervisor clock 64 in FIG. *7i* is reset via associated control circuitry and which too forms a portion of the condition decode circuitry 52. If neither a tamper or sensor input is thereafter detected for approximately 69 minutes, the supervisor timer times out and initiates the transmission of two messages.

Relative to the particular numbers of messages transmitted, and in addition to the control functions already mentioned, the condition decode circuitry 52 and which has been shown as being partially compartmentalized in FIGS. *7h* and *7i*, although it also contains various other distributed logic circuitry that will be discussed, logically processes the conditions of the tamper input, the verified sensor condition and the various selected RESTORE, EMERGENCY, SUPERVISED, SMOKE and LOCKOUT options to initiate the message counter 54 in FIG. *7i* with an appropriate number of messages. Once therefore the message initiating condition is detected, transmissions begin and continue, until the message counter 54 counts down and transmits an END clock signal used to re-set the supervisor portion of clock 64 and disable the active control line to the clock portions 46*b–d* and the various other control circuitry coupled to the tamper, sensor and alarm transition bits. The number of messages being transmitted again corresponding to two messages for a supervised condition, four messages for either a restore or a tamper condition, eight messages for a normal sensor transition and sixteen messages for an emergency type sensor transition. The time between messages is again established by the inter-message counter portion 46*d* of FIG. *7c* in relation to the transmitting sensor number.

The frequency at which the oscillator 14 operates is in turn established via the frequency shift option at the register 40 and a corresponding control signal is coupled to terminal pin 2, along with each message transmission that is coupled to the terminal pin 1 of the sensor transmitter 20.

Finally, it is to be noted that the sleep option, if programmed at the pre-condition register 40, is coupled at the output of the oscillator 56 to a NAND gate 86 (Ref. FIGS. *7a*, *7d* and *7g*) before the oscillator output is coupled to the timer 46. Thus, upon programming a sleep condition, the sensor transmitter can be disconnected from the crystal oscillator 56. Essentially no power will thereafter be consumed by the sensor transmitter, until the sleep condition is overridden by the user via the programmer 6.

Figure 8A:
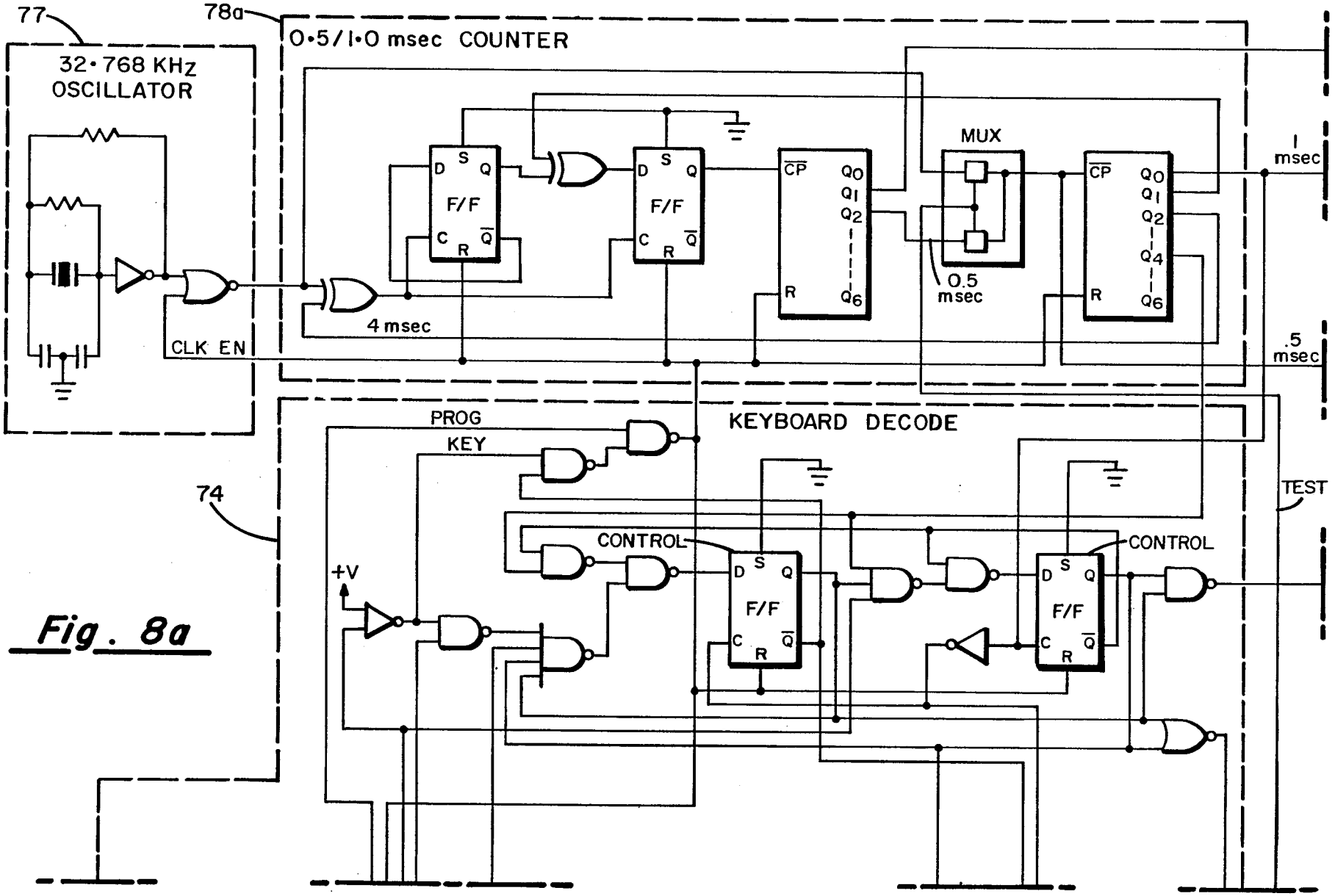
FIG. 8 shows the positional alignment of FIGS. 8*a* through 8*i* and which in turn show a detailed electrical schematic diagram of the user data input transmitter integrated circuit of FIG. 6.
Figure 8B:
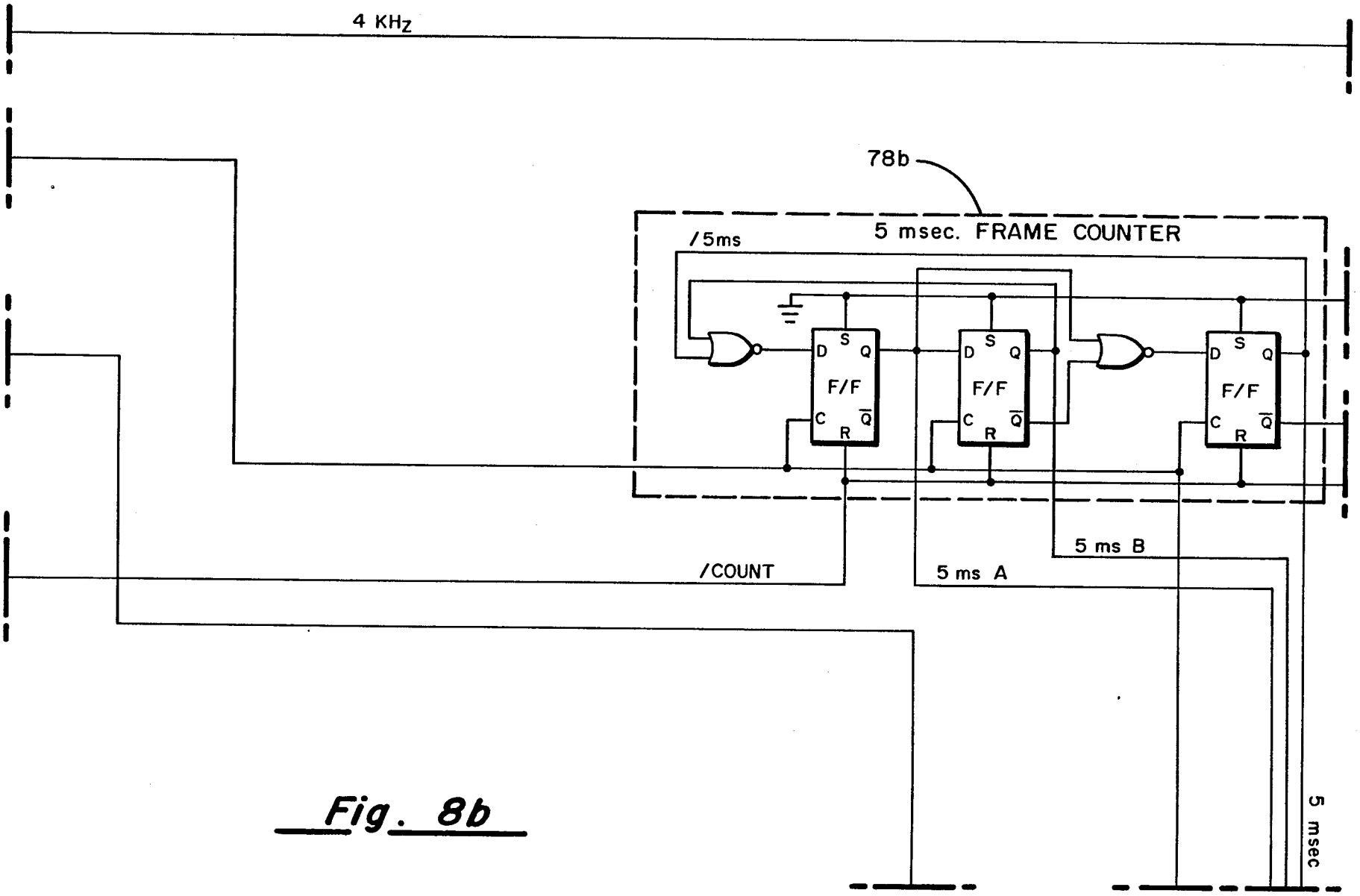
Figure 8C:
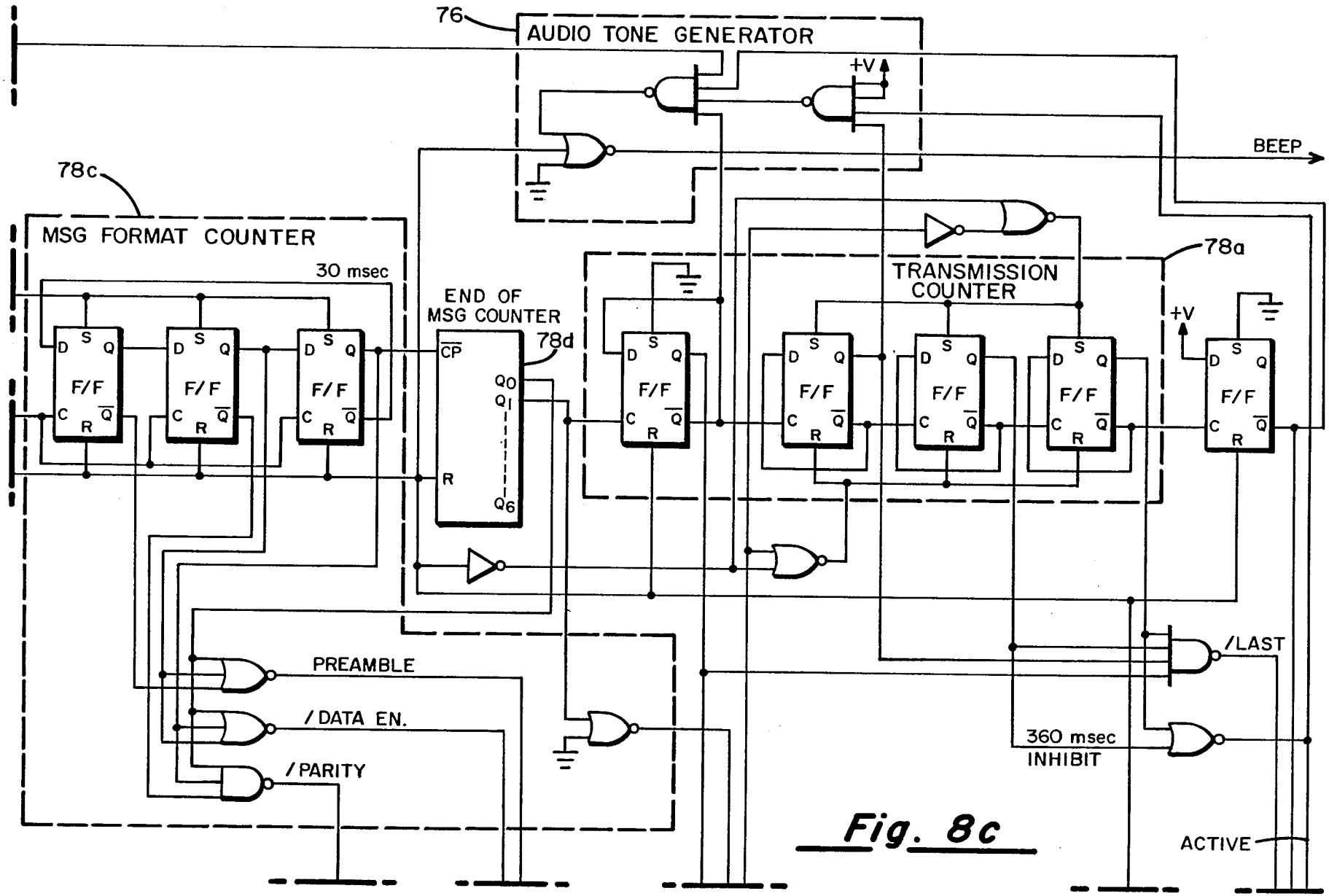

Directing attention lastly to the UDI transmitter circuitry of FIG. 8 and in particular to FIG. 8*a*, the 32.768 Khz oscillator 78 is shown and which provides basic timing to the UDI transmitter 28. The specific inter/intramessage timing signals are derived from the oscillator output via the inter/intra-message timing circuitry 78. One portion 78*a* of the timer 78 is shown in FIG. 8*a* and operates to produce clock outputs of 0.5 and 1.0 msec. These clock outputs being used among other things to shift the data through the shift register 70 and in the encoding of the binary data in the pulse position encoded messages produced at the compare transmit circuitry 82 in FIG. 8*f*. A second portion 78*b* of the clock is shown in FIG. 8*b* and produces a 5 msec clock used to define the various data frames of each message. A third portion 78*c* shown in FIG. 8*c*, in turn, formats the 5 millisecond data frames of each message by producing attendant enable signals for controlling the transmission of the data through the parity generating circuitry 80, compare transmit circuitry 82 and filter 84. Also shown in FIG. 8*c* is the end of message counter 78*d* and which establishes a maximum message length of 60 msec.

Lastly, a portion 78*e* responsive to the end of message counter 78*d* counts each message as it is transmitted and which it is to be recalled for normal key entries will comprise six messages per transmission and for emergency key entries twelve messages per transmission. In particular and depending upon the type of transmission, the counter 78*e* is jammed with an appropriate initial count and from which the counter counts until it overflows and at which time a control signal indicating end of transmission is produced. Counter 78*e* also produces the timing signals for controlling the transmission of the audible feedback tone relative to the type of key pressed. That is, for a normal key, the tone will continue for 60 msec as established by the leftmost flip-flip of the counter 78*a*. For an emergency key however and after the first tone, a 360 msec pause occurs before six successive tones are transmitted for periods of 120 msec on and 120 msec off.

Figure 8D:
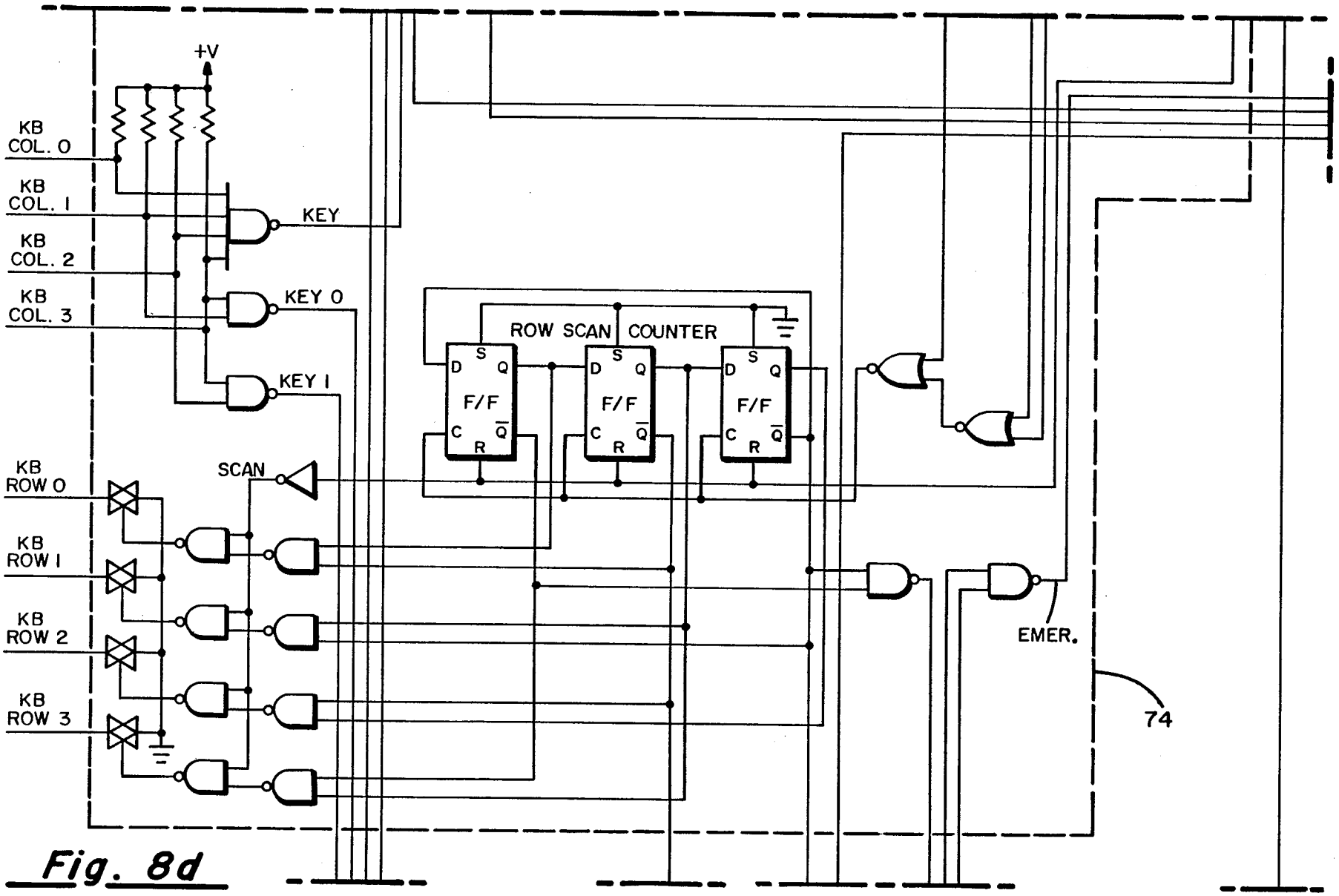
Figure 8E:
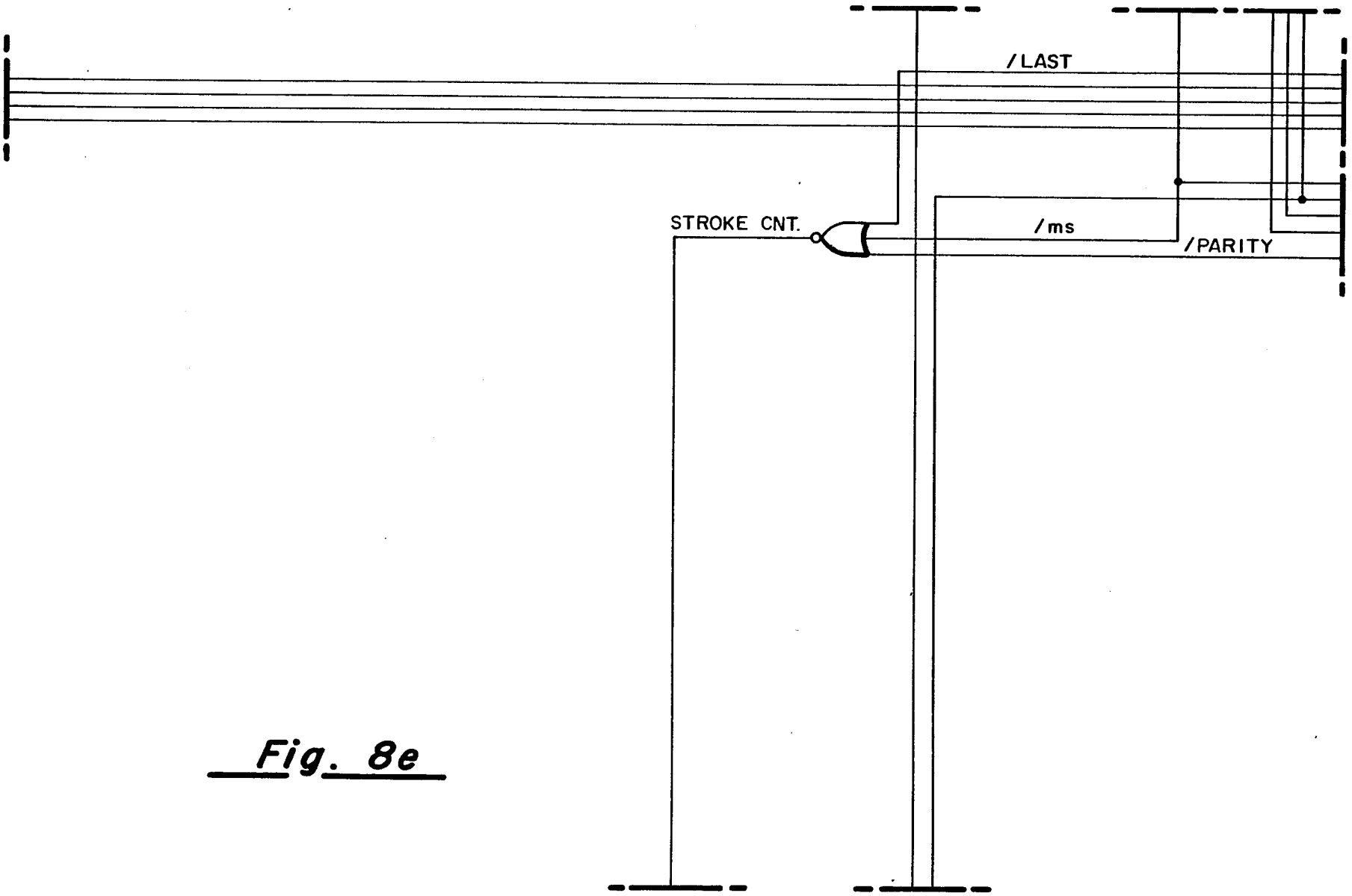
Figure 8F:
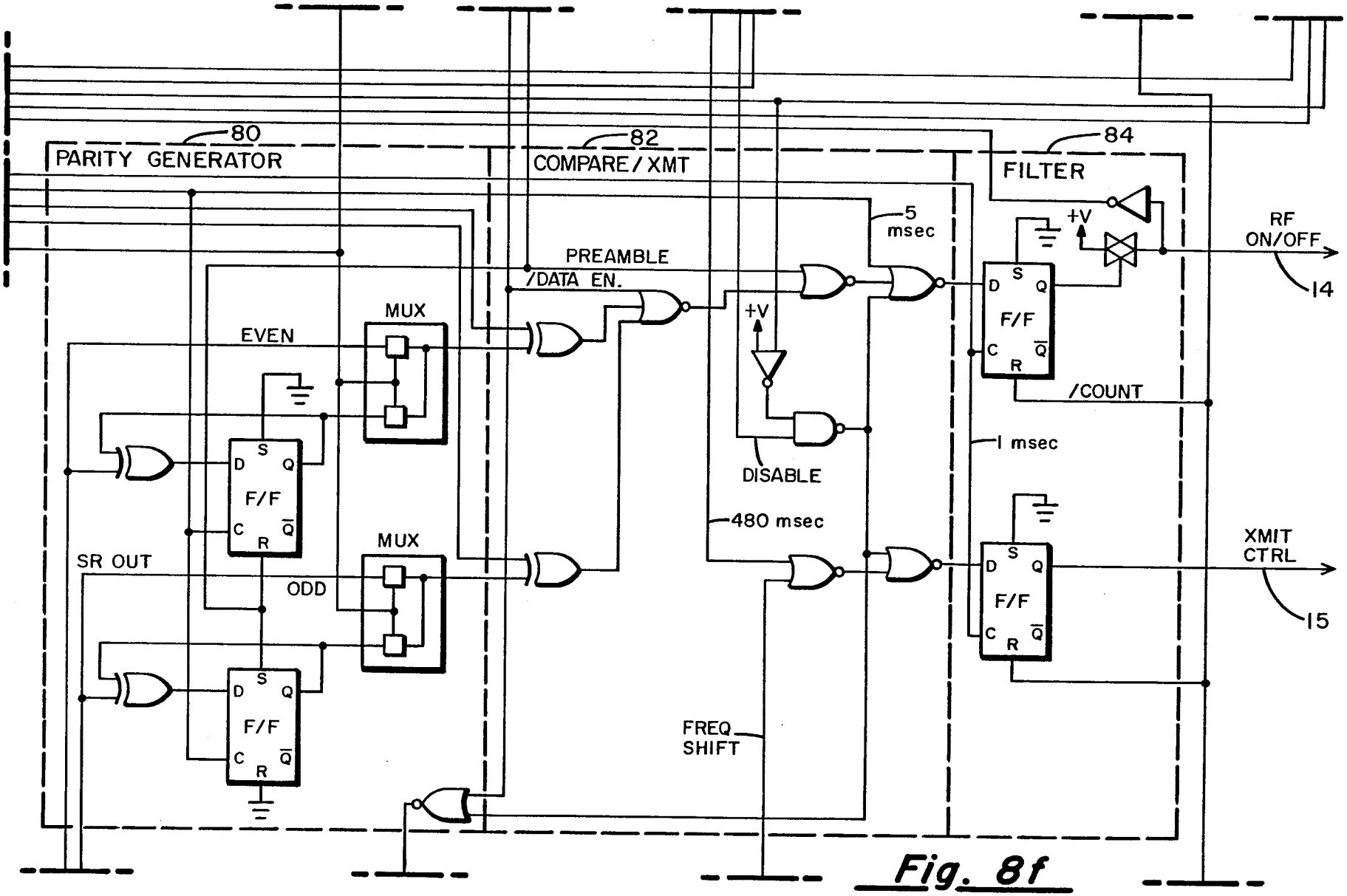
Figure 8G:
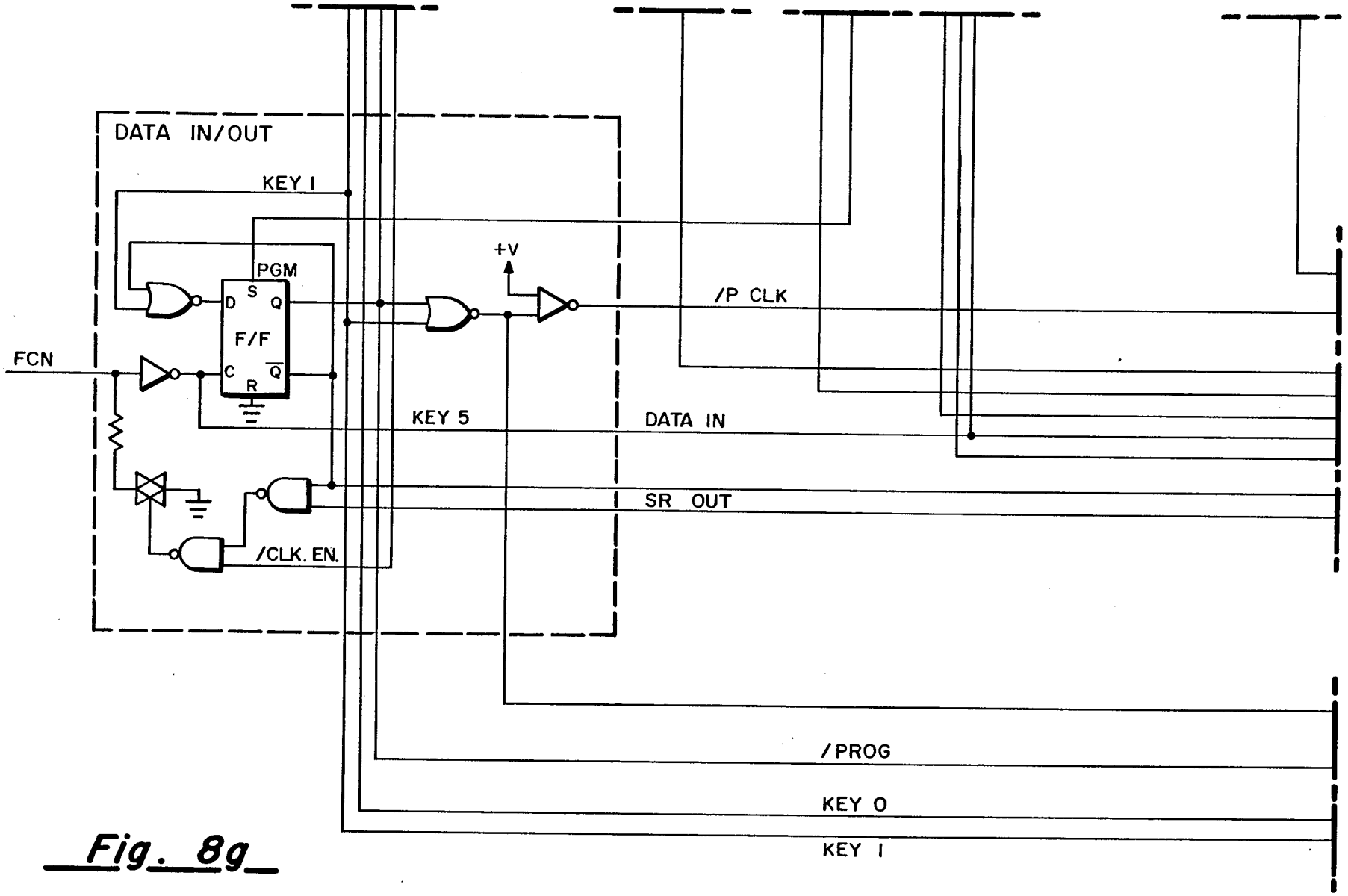
Figure 8H:
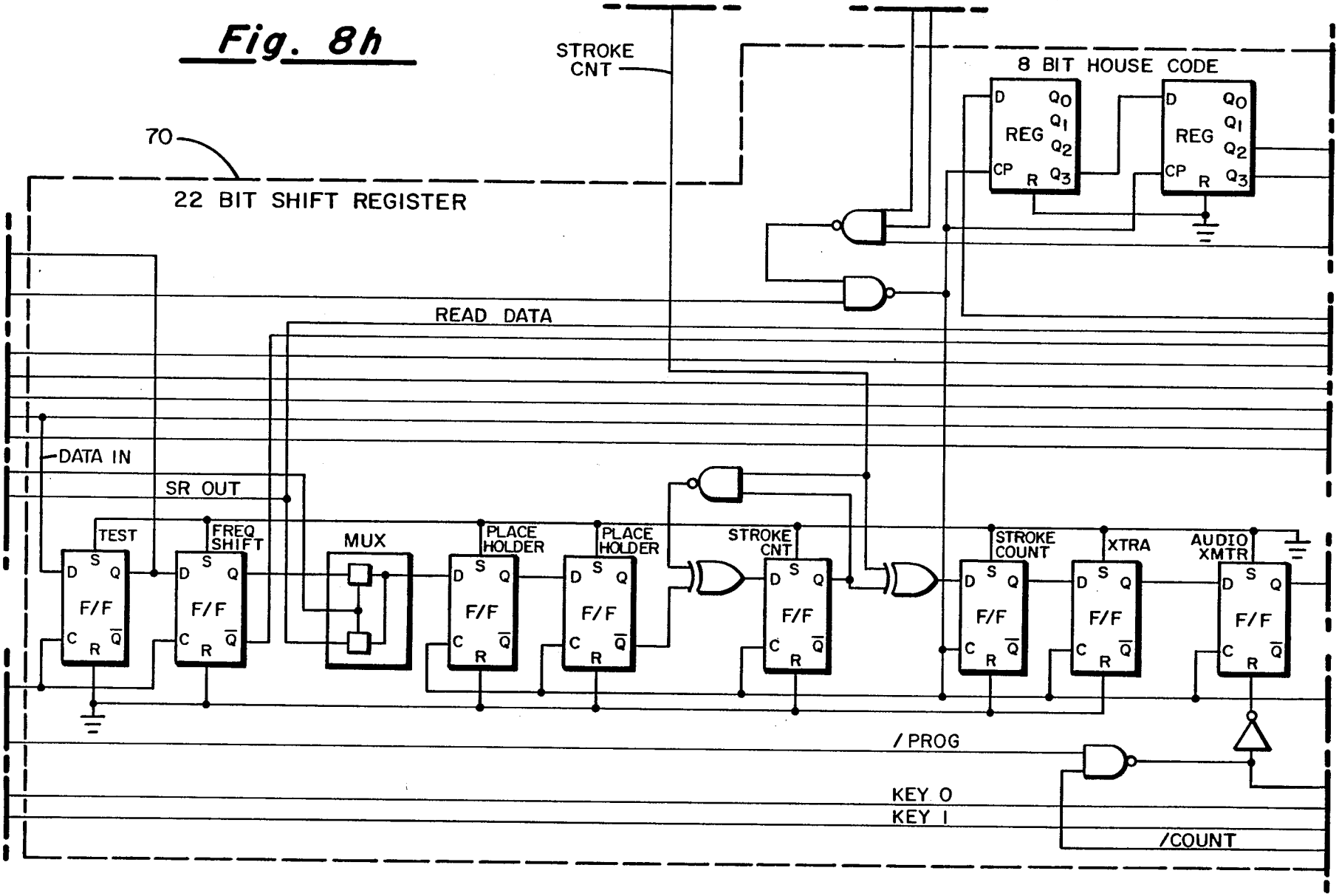
Figure 8I:
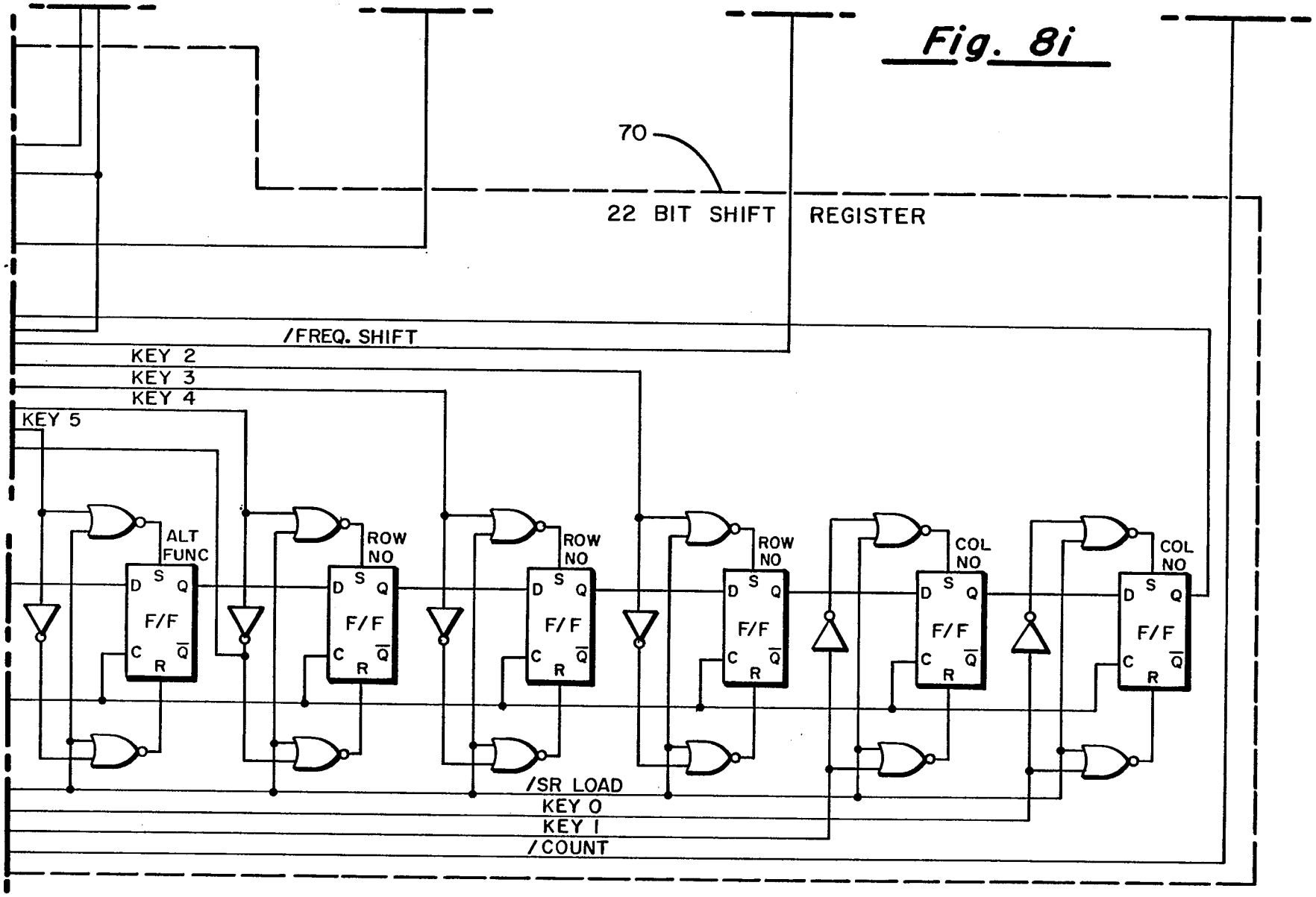

Turning attention next to FIG. 8*h* and 8*i*, the 22-bit shift register 70 is shown. While 22 bits are stored in the register, again only 20 bits are transmitted with each message. Reading from left to right or from the most significant bit to the least significant bit, the first register stage is programmed with a test input, while the next stage is programmed with the frequency shift input. These inputs being selectively programmable via the programmer 6. The test stage essentially enables the bypassing of the clock portion 78*a*, while the frequency shift stage allows the programming of the oscillator 14 on for 5 msec before the transmission of each message and off at the end of each message or alternatively, causes the oscillator 14 to shift its frequency with every other message transmitted. The next two register stages act as place holders for the parity data transmitted with each message and which data is loaded via the parity generator 88, shown in FIG. 8*f*, at the last data frame with the state of the even and odd parity respectively occurring at the nineteenth and eighteenth bit positions of each message. The next two stages contain the stroke count data, with the rightmost stage being incremented with each key depression such that multiple key depressions can be distinguished from one another by the system controller 2 upon receipt of the successive messages. The next stages respectively relate to an extra bit which is presently unused and the fourteenth bit position which identifies the transmitter as being a UDI transmitter 28 as distinguished from a sensor transmitter 20. The next six stages respectively identify three bits of row data and two bits of column data. The last eight stages store the programmed house code.

Relative to the programming of the UDI transmitter 28, attention is directed to FIG. 8*g* and the function input terminal 1 and relative to which the flow of data is controlled. This terminal, because it is also coupled to the alternate function switch 26, as mentioned, effectively expands the number of available keys by allowing the assignment of multiple functions to each key. During programming or the interrogation of the UDI, however, this terminal acts as a serial input/output port. Thus, assuming the programmer 6 is coupled to the UDI transmitter and it is desired to read the contents of the shift register 70, upon depressing the programmer read key, the program flip-flop in FIG. 8*g* causes the multiplexer coupled to the first placeholder stage of the register 70 to shift the data out through the function terminal 1. Alternatively, if the enter key is depressed at the programmer 6, the output of the program flip-flop is logically processed to cause the 0.5 msec clock signal to be coupled to the clock inputs to each shift register and thereby shift the data at the function input through the stages of the shift register 70. In so doing, the house code and UDI transmitter bit are set and later transmitted with each message. All other transmitted message data comprising that which is entered by way of the keyboard 72.

In this latter regard, attention is directed to the keyboard decode circuitry 74 and which is disclosed in FIGS. 8*a* and 8*d*. This circuitry generally operates upon the depression of any of the UDI keyboard 72 keys to decode the depressed key by row and column and load the shift register 70 with the decoded information. More particularly, the column inputs are normally high while the row inputs are normally low. However, upon the depression of one of the keys, the associated column input goes low and after an 8 msec debounce period all row outputs are driven to a logic high and then sequentially pulsed low via the row scan counter in FIG. 8*d*, until the counter is stopped. The counter output at that time identifies one of the keyboard rows and causes three associated stages of the shift register 70 to be set with corresponding binary data. The depressed column meanwhile is decoded via associated logic circuitry to set the two column stages with appropriate binary data and whereby the system controller 2 upon decoding the three bits of row information and two bits of column information is able to identify the depressed key and selected function.

If too one of the keys in the fifth row and which correspond to the emergency keys had been depressed, the row scan counter would have been immediately stopped and the position of the depressed key would have been stored at the register stage identifying the emergency key. The state of the row scan counter would also be logically decoded and coupled along with the input from the fifth row key to enable the tone generator for 60 msec. If the fifth row key remained depressed after a 360 msec wait and the initiation of a second beep, the entered data would be transmitted. Alternatively, if the key were released, no message would be transmitted and the control flip-flops shown in FIG. 8*a* would reset to a 0 0 condition. Relative to the control flip-flop outputs, it is to be noted that during a 1 0 condition, the decode circuitry 74 is searching for a key; during a 1 1 condition, the row scan counter is stopped and the data is transmitted; while during the 0 1 condition, the control flip-flops are waiting for the release of the key before returning to a 0 0 condition.

Turning attention to the parity generator 80, compare transmit circuitry 82 and filter 84, this circuitry is shown in detail in FIG. 8*f*. As with the sensor transmitter 20, the data is shifted out of the shift register 70 two bits at a time via the multiplexers coupled to the odd and even outputs of the least two significant bit positions, before being formatted at the compare transmit circuitry 82 within each of the various data and parity frames subsequent to the preamble frame. Again, two bits of data are relegated to each 1 msec pulse within each 5 msec data frame. Also, it is to be noted that depending upon the selection of the FREQUENCY SHIFT option, this output and the disable output from the message counter are logically processed to assure that the data being transmitted from the RF on/off terminal 15 is transmitted at an appropriate frequency as established at the transmit control output on terminal 15.

Lastly, attention is directed to the source code listing for the programmer 6 which is accessed by its microprocessor to operate in the foregoing described fashion. This program is as follows:

TABLE 1

```
        TITLE    STICK TRANSMITTER AND KEYPAD PROGRAMMER  25-JUN-85
        RADIX   H

*****************************************************************
*       KEY CODES AND TASK NUMBERS                              *
*****************************************************************
ILDAE   EQU     0C6             LDA EXTENDED INSTRUCTION
IRTS    EQU     81              RTS INSTRUCTION
POFT    EQU     09              POWER OFF TIME IN 67.1 SEC UNITS
QOCT1   EQU     08              LAST OCTAL DIGIT + 1
QNUM1   EQU     0A              LAST NUMBER + 1
QOPT1   EQU     10              LAST OPTION + 1
QHC     EQU     10              HOUSE CODE KEY
QSN     EQU     11              SENSOR NUMBER KEY
QTYPE   EQU     12              SENSOR TYPE KEY
QEXADD  EQU     13              CHANGE EXAM ADDRESS
QEXOFF  EQU     14              EXAM OFF
QREAD   EQU     16              READ KEY
QSLEEP  EQU     17              SLEEP KEY
QENTER  EQU     18              ENTER PROGRAM KEY
QIDLE   EQU     0FF             WAITING IDLE FOR A KEY

*****************************************************************
*       I/O DEFINITIONS                                         *
*****************************************************************
HPORTA  EQU     00              PORT A DATA
HPORTB  EQU     01              PORT B DATA
HPORTC  EQU     02              PORT C DATA
HDDRA   EQU     04              PORT A DIRECTION
HDDRB   EQU     05              PORT B DIRECTION
HDDRC   EQU     06              PORT C DIRECTION
HTDATA  EQU     08              TIMER DATA
HTCONT  EQU     09              TIMER CONTROL
HPCONT  EQU     0B              EPROM CONTROL

*****************************************************************
*       MACRO FOR DEFINING LOCATIONS IN MEMORY MAP              *
*****************************************************************
RB      MACRO   NUMBIT          FORMAT:  LABEL  RB   n
        ORG     $+NUMBIT        ADVANCE DEFINITION COUNTER
        MACEND

*****************************************************************
*       INITIALIZED RAM DEFINITIONS                             *
*****************************************************************
        ABSOLUTE
        MACLIST OFF

        ORG     40              6805 RAM STARTS AT 40H
KLOW    RB      1               LOWER 3 BITS OF KEY SCAN
KEY1    RB      1               USED IN DETECTING KEYS
KNEW    RB      1               NEW KEY NUMBER
KOLD1   RB      1               KEY NUMBER FOR DEBOUNCE
KOLD2   RB      1               KEY NUMBER FOR AVOIDING DOUBLE KEY
SETHC   RB      3               BCD HOUSE CODE
SETSN   RB      2               OCTAL SENSOR NUMBER
SETOPT  RB      1               BINARY OPTION CODE
*                                 0 SUPERVISED    4 EMERGENCY
```

```
*                                   1 NORM OPEN .    5 SMOKE DELAY
*                                   2 RESTORE        6 FREQ SHIFT
*                                   3 LOCKOUT        7 TEST MODE
SETCNG   RB      1                POINTER TO ITEM BEING CHANGED
EXADD    RB      4                EXECUTABLE RAM FOR EXAMINING MEMORY
COUNTS   RB      1                TIMOUT COUNTER
FLAGS    RB      1                ONE BIT FLAGS
*                                   BIT 0 = ANY CHANGE KEY PRESSED
*                                   BIT 1 = WORD MESSAGE
*                                   BIT 2 = 0 FOR KEYPAD, 1 FOR SENSOR
BSAVE    RB      3                BATTERY SAVER TIMER
*****************************************************************
*        NON-INITIALIZED RAM DEFINITIONS                        *
*****************************************************************
RTEMP    RB      1                TEMPORARY RAM
DSPHC    RB      3                HOUSE CODE DISPLAY DIGITS
DSPSN    RB      2                SENSOR NUMBER DISPLAY DIGITS
DSPOPT   RB      1                OPTION LED DISPLAY
PROHC    RB      1                BINARY HOUSE CODE
PROD1    RB      1                PROGRAM DATA 1
*                                   SENSOR: 6 BIT SENSOR NUMBER
*                                   KEYPAD: HEX 33

PROD2    RB      1                PROGRAM DATA 2
*                                 BIT     SENSOR          KEYPAD
*                                  0      1               0
*                                  1      0               EXTRA BIT
*                                  2      0               STROKE CNT 0
*                                  3      0               STROKE CNT 1
*                                  4      IGNORED,KEPT    IGNORED,KEPT
*                                  5      SUPERVISED      IGNORED,KEPT
*                                  6      NORM OPEN       FREQ SHIFT
*                                  7      RESTORE         TEST MODE

PROD3    RB      1                PROGRAM DATA 3
*                                   KEYPAD: UNUSED
*                                   SENSOR:                3  FREQ SHIFT
*                                   0  LOCKOUT             4  TEST MODE
*                                   1  EMERGENCY           5  SLEEP
*                                   2  SMOKE DELAY         6,7 UNUSED

REDHC    RB      1                READ HOUSE CODE
REDD1    RB      1                READ DATA 1
REDD2    RB      1                READ DATA 2
REDD3    RB      1                READ DATA 3
PBOUT    RB      1                CURRENT PB6, PB7 OUTPUT
FSOFF    RB      1                BIT 0 = FREQ SHIFT SWITCH POS, 1-OFF

*****************************************************************
*        TABLES                                                 *
*****************************************************************
         ORG     80               TABLES
T7SEG    DB      3F,06,5B,4F      0, 1, 2, 3
         DB      66,6D,7D,07      4, 5, 6, 7
         DB      7F,6F,77,7C      8, 9, A, b
         DB      39,5E,79,71      C, d, E, F
         DB      00               BLANK FOR LEADING ZEROES

TMSG
TMSLP    DB      6D,38,79,79,73   SLEEP
TMERR    DB      79,50,50,5C,50   Error
TMDON    DB      00,5E,5C,54,79    donE
TMFAL    DB      00,71,77,30,38    FAIL
```

```
TMLOP   DB      00,00,00,00,04          ,
TMON    DB      76,79,38,38,3F          HELLO

TOPTOG  DB      01,02,04,08             OPTION TOGGLES
        DB      10,20,40,80

TOPTS   DB      07,05,0D,01,01          FREEZE,DOOR,MOTION,SOUND,SHOCK
        DB      0F,17,16,35,17          MAT,F.PANIC,P.PANIC,SMOKE,HEAT

TKHIGH  DB      1F,1F,1F,06             OR WITH KLOW FOR POINTER TO TKTAB
        DB      1F,07,1F,18
        DB      1F,1F,1F,10
        DB      1F,08,00,1F

TKTAB   DB      0C,0D,0E,0F             N.O., RESTORE, LOCKOUT, EMERG
        DB      10,00,14,15             SMOKE, ILLEGAL, EXAM ON, EXAM OFF
        DB      13,04,07,0A             SENSOR TYPE, 3, 6, 9
        DB      0B,00,00,00             SUPERVISED, ILLEGAL, ILLEGAL, ILLEGAL
        DB      12,03,06,09             SENSOR NUMBER, 2, 5, 8
        DB      19,18,00,00             ENTER, SLEEP, ILLEGAL, ILLEGAL
        DB      11,02,05,08             HOUSE CODE, 1, 4, 7
        DB      01,17,00,FF             0, READ, ILLEGAL, NO KEY

*****************************************************************
*       RAM INITIALIZATION TABLE                                *
*****************************************************************
TINIT   DB      05                      KLOW
        DB      FF                      KEY1
        DB      FF                      KNEW
        DB      FF                      KOLD1
        DB      FF                      KOLD2
        DB      00,00,00                SETHC
        DB      00,00                   SETSN
        DB      05                      SETOPT
        DB      QHC                     SETCNG
        DB      00,00,00,00             EXADD
        DB      00                      COUNTS
        DB      00                      FLAGS
        DB      00,00,POFT              BSAVE
TIEND

*****************************************************************
*       INITIALIZATION                                          *
*****************************************************************
INIT    SEI                             DISABLE INTERRUPTS
        RSP                             INITIALIZE STACK
        LDA     #FF
        STA     HDDRA                   A ALL OUTPUTS
        STA     HDDRB                   B ALL OUTPUTS
        STA     HTDATA                  TIMER
        CLR     A                       CLEAR:
        STA     HPORTA                  PORT A
        STA     HDDRC                   PORT C DIRECTION
        LDA     #A0                     SENSOR HIGH, TAMPER LOW, LOOK AT FS SW
        STA     HPORTB                  PORT B
        LDA     #0A                     CLOCK DIVIDED BY 4 (250 KHZ)
        STA     HTCONT                  TIMER CONTROL
        LDX     #TIEND-TINIT-1          POINT TO END OF INIT TABLE
INIT1   LDA     TINIT,X                 GET INITIAL VALUE
        STA     KLOW,X                  INITIALIZE RAM
        DEC     X                       NEXT X
        BPL     INIT1                   BACK TILL COMPLETE
        LDA     HPORTC                  GET INPUTS
```

```
        STA     FSOFF           SAVE IT
        BRSET   0,FSOFF,FSOK    FS SWITCH IS OFF
        BSET    6,SETOPT        SET FS BIT
FSOK    CLI                     ENABLE INTERRUPTS
        LDX     #TMON-TMSG      HELLO MESSAGE
*****************************************************************
*       DISPLAY WORD MESSAGES                                   *
*****************************************************************
JMESG   BSET    1,FLAGS         WORD MESSAGES DON'T FLASH
        LDA     TMSG,X          GET FIRST CHARACTER
        STA     DSPHC           LEFT POSITION
        LDA     TMSG+1,X        SECOND CHARACTER
        STA     DSPHC+1
        LDA     TMSG+2,X
        STA     DSPHC+2
        LDA     TMSG+3,X
        STA     DSPSN
        LDA     TMSG+4,X
        STA     DSPSN+1
        CLR     DSPOPT          TURN OFF OPTION LED'S
*****************************************************************
*       MAIN WAIT LOOP                                          *
*****************************************************************
WAIT    LDA     KOLD1           GET LAST KEY NUMBER
        STA     KOLD2           SAVE IT TO AVOID DUPLICATION
WAITC   LDA     COUNTS          TIMER YET?
        BEQ     WAITC           NO
        DEC     COUNTS          INDICATE DOING TASK
*****************************************************************
*       KEY CODE INTERPRETATION                                 *
*****************************************************************
KEYIN   LDX     KNEW            GET NEW KEY CODE
        CPX     KOLD1           DEBOUNCED YET?
        BNE     NOKEY           NO.
        CPX     KOLD2           HAVE WE DONE IT YET?
        BEQ     NOKEY           YES.
        TST     X               KEY JUST RELEASED?
        BMI     WAIT            YES.
        CLR     BSAVE+1         RESET BATTERY SAVER TIMER
        LDA     #POFT           GET TIME TO POWER DOWN
        STA     BSAVE+2         SAVE IT
        JMP     DOIT            PERFORM KEY FUNCTION

*****************************************************************
*       BATTERY SAVER AND FLASHING DISPLAY                      *
*****************************************************************
NOKEY   INC     BSAVE           EVERY 1.024 MS WHILE IDLE
        BNE     BSNO            NOTHING TO DO YET
        INC     BSAVE+1         EVERY 262 MS
        BNE     BS1             NOT BATT SAVE TIME
        DEC     BSAVE+2         TIME FOR POWER DOWN?
        BEQ     BOFF            YES. DIE NOW.
        LDX     #TMLOP-TMSG     ONE SEGMENT ON
        JMP     JMESG           DISPLAY IT
BOFF    SEI                     DISABLE INTERRUPTS
        CLR     HPORTA          TURN OFF DISPLAY
        CLR     HPORTB          TURN OFF POWER
OFF1    BRA     OFF1            DIE QUIETLY
BS1     BRSET   1,FLAGS,BSNO    DON'T FLASH MESSAGES
        LDA     BSAVE+1         GET TIMER
        AND     #03             LOOK AT 2 BITS
        CMP     #03             DISPLAY BACK ON?
        BNE     NDON            NO.
```

```
        JMP     DSPON           TURN DISPLAY ON
NDON    CMP     #02             BLANK SOMETHING?
        BNE     BSNO            NO
        CLR     A               BLANKING CHARACTER
        LDX     SETCNG          WHAT DO WE BLANK?
        CPX     #QTYPE          OPTION LEDS?
        BNE     NQTYPE          NO
        STA     DSPOPT          TURN THEM OFF
        BRA     BSNO
NQTYPE  CPX     #QSN            SENSOR NUMBER?
        BNE     NQSN            NO.
        STA     DSPSN           BLANK SENSOR NUMBER
        STA     DSPSN+1
        BRA     BSNO
NQSN    STA     DSPHC           BLANK HOUSE CODE
        STA     DSPHC+1
        STA     DSPHC+2
*****************************************************************
*       EXAMINE MEMORY                                          *
*****************************************************************
BSNO    LDA     EXADD+3         IS 'RTS' INSTRUCTION IN PLACE?
        CMP     #IRTS           'RTS'?
        BNE     WAIT1           NO
        LDA     #ILDAE          'LDA' EXTENDED INSTRUCTION
        STA     EXADD           SAVE IT
        JSR     EXADD           DO IT
        STA     EXADD           SAVE RESULT
        LSR     A               LOOK AT HIGH NIBBLE
        LSR     A
        LSR     A
        LSR     A
        TAX                     IT IS AN INDEX
        LDA     T7SEG,X         GET 7 SEGMENT PATTERN
        STA     DSPSN           SAVE HIGH DISPLAY
        LDA     EXADD           GET DATA AGAIN
        AND     #0F             LOOK AT LOW NIBBLE
        TAX
        LDA     T7SEG,X         GET 7 SEGMENT PATTERN
        STA     DSPSN+1         SAVE LOW DISPLAY
WAIT1   JMP     WAIT            WAIT FOR INTERRUPT

*****************************************************************
*       CHANGE KEYS                                             *
*****************************************************************
DOIT    CPX     #QHC            CHANGE HOUSE CODE?
        BEQ     CHANGE          YES
        CPX     #QSN            CHANGE SENSOR NUMBER?
        BEQ     CHANGE          YES
        CPX     #QTYPE          CHANGE SENSOR TYPE?
        BEQ     CHANGE          YES
        CPX     #QEXADD         SET EXAM ADDRESS?
        BNE     NCNG            NO. LOOK FOR OTHER FUNCTIONS
        LDA     #IRTS           RTS INSTRUCTION
        STA     EXADD+3         SAVE IT TO TURN ON EXAM
        BRA     EXADC           SET UP TO CHANGE ADDRESS
CHANGE  LDA     KOLD2           GET PREVIOUS KEY
        CMP     #QEXADD         WAS IT SET EXAM ADDRESS?
        BNE     EXADC           NO.
        JMP     NOKEY           YES. IGNORE THIS KEY
EXADC   STX     SETCNG          THIS IS WHAT CHANGES NEXT
        BSET    0,FLAGS         INDICATE CHANGE KEY PRESSED
        JMP     JDISP           DISPLAY
```

```
*****************************************************************
*       NUMBER KEYS 0 - 9                                       *
*****************************************************************
NCNG    CPX     #QNUM1          WAS IT A NUMBER KEY?
        BHS     NNUMB           NO.
        LDA     SETCNG          WHAT ARE WE CHANGING?
        CMP     #QSN            CHANGE SENSOR NUMBER?
        BNE     NSNUM           NO
        CPX     #QOCT1          LEGITIMATE OCTAL NUMBER?
        BHS     DISP1           NO. IGNORE IT.
        CLR     A               ZERO HIGH DIGIT
        BRSET   0,FLAGS,SN1     A NEW NUMBER
        LDA     SETSN           GET ONES
SN1     STA     SETSN+1         NOW TENS
        STX     SETSN           NEW ONES
        BCLR    0,FLAGS         ONLY FOR FIRST DIGIT
        BRA     DISP1           NEXT TASK IS DISPLAY
NSNUM   CMP     #QTYPE          SENSOR TYPE?
        BNE     NTYPE           NO
        LDA     TOPTS,X         GET OPTION SETTING FROM TABLE
        AND     #BF             CLEAR FREQ SHIFT BIT
        STA     SETOPT          STORE OPTIONS
        BRSET   0,FSOFF,DISP1   FS SWITCH IS OFF
        BSET    6,SETOPT        INDICATE FS SWITCH ON
        BRA     DISP1           DISPLAY IT
NTYPE   BRCLR   0,FLAGS,HC1     NOT A NEW NUMBER
        BCLR    0,FLAGS         DON'T DO THIS AGAIN
        CLR     SETHC+1         CLEAR TENS
        CLR     SETHC+2         CLEAR HUNDREDS
        BRA     HC2
HC1     LDA     SETHC+1         GET TENS
        STA     SETHC+2         NOW HUNDREDS
        LDA     SETHC           GET ONES
        STA     SETHC+1         NOW TENS
HC2     STX     SETHC           KEY IS ONES
        LDA     SETCNG          SETTING HOUSE CODE?
        CMP     #QHC
        BEQ     DISP1           YES. DISPLAY IT.
        LDA     SETHC+1         GET 16'S DIGIT
        LSL     A               SHIFT IT LEFT TO HIGH NIBBLE
        LSL     A
        LSL     A
        LSL     A
        ORA     SETHC           INCLUDE ONES DIGIT
        STA     EXADD+2         SAVE LOW BYTE OF ADDRESS
        LDA     SETHC+2         GET 256'S DIGIT
        STA     EXADD+1         SAVE HIGH BYTE OF ADDRESS
DISP1   JMP     JDISP           DISPLAY IT

*****************************************************************
*       OPTION KEYS A - F                                       *
*****************************************************************
NNUMB   CPX     #QOPT1          OPTION KEY?
        BHS     NOPT            NO.
        LDA     SETCNG          ARE WE SETTING EXAM ADDRESS?
        CMP     #QEXADD
        BEQ     NTYPE           YES. OPTION KEYS ARE HEX LETTERS.
        LDA     TOPTOG-QNUM1,X  GET OPTION TO TOGGLE
        EOR     SETOPT          TOGGLE IT
        STA     SETOPT          SAVE IT
        BRA     DISP1           DISPLAY IT
```

```
*****************************************************************
*       READ KEY                                                *
*****************************************************************
NOPT    CPX     #QREAD          READ KEY?
        BNE     NREAD           NO.
        JSR     JREAD           READ DEVICE
        BRCLR   2,FLAGS,DKPD    SKIP IF KEYPAD
        BRCLR   5,REDD3,DKPD    SKIP IF NOT "ASLEEP"
        LDX     #TMSLP-TMSG     SLEEP MESSAGE
        JMP     JMESG           SHOW IT
DKPD    LDX     #FF             INIT COUNTER
        LDA     REDHC           GET HOUSE CODE
HUND    INC     X               INCREMENT COUNTER
        ADD     #9C             SUBTRACT 100
        BCS     HUND            CONTINUE UNTIL BORROW
        STX     SETHC+2         SAVE HUNDREDS DIGIT
        ADD     #64             ADD 100
        LDX     #FF             INIT COUNTER AGAIN
TENS    INC     X               INCREMENT COUNTER
        ADD     #F6             SUBTRACT 10
        BCS     TENS            CONTINUE UNTIL BORROW
        STX     SETHC+1         SAVE TENS DIGIT
        ADD     #0A             ADD 10
        STA     SETHC           SAVE ONES DIGIT
        BRSET   2,FLAGS,DSENS   DECODE FOR SENSOR
        LDA     REDD2           GET DATA 2
        AND     #40             PICK OFF FREQ SHIFT
        STA     SETOPT          THAT IS ONLY OPTION
        LDA     REDD2           GET DATA 2
        AND     #02             PICK OFF EXTRA
        LSR     A               IN BIT 0
        BNE     EX1             SET
        LDA     #02             CONVERT 0 TO 2
EX1     STA     SETSN           THIS IS "SENSOR NUMBER"
        CLR     A               HIGH BITS 0
        STA     SETSN+1
        JMP     JDISP           DISPLAY IT
DSENS   LDA     REDD1           GET SENSOR NUMBER
        AND     #07             LOWER 3 BITS
        STA     SETSN           SAVE IT
        LDA     REDD1           GET IT AGAIN
        LSR     A               NEXT 3 BITS
        LSR     A
        LSR     A
        STA     SETSN+1         SAVE IT
        LDA     REDD3           GET DATA 3
        LSL     REDD2           SHIFT IN THREE BITS FROM DATA 2
        ROL     A
        LSL     REDD2
        ROL     A
        LSL     REDD2
        ROL     A
        AND     #7F             CLEAR BIT 7
        STA     SETOPT          THESE ARE OPTION BITS
        JMP     JDISP           DISPLAY IT

*****************************************************************
*       ERROR MESSAGE                                           *
*****************************************************************
ERROR   LDX     #TMERR-TMSG     ERROR MESSAGE
        JMP     JMESG           SHOW IT
```

```
*****************************************************************
*       ENTER KEY                                               *
*****************************************************************
NREAD   CPX     #QENTER         ENTER KEY?
        BEQ     ENTER           YES.
        JMP     NENTER          NO.
ENTER   JSR     JREAD           READ TRANSMITTER
        LDA     SETHC+2         HUNDREDS DIGIT
        ASL     A               *10
        ASL     A
        ADD     SETHC+2
        ASL     A
        ADD     SETHC+1         ADD TENS DIGIT
        STA     PROHC
        ASL     A               *10
        ASL     A
        BCS     ERROR
        ADD     PROHC
        BCS     ERROR
        ASL     A
        BCS     ERROR
        ADD     SETHC           ADD ONES DIGIT
        BCS     ERROR
        BEQ     ERROR           DON'T ALLOW HOUSE CODE 0
        STA     PROHC           BINARY HOUSE CODE
        BRSET   2,FLAGS,ESENS   THIS IS A SENSOR
        LDA     #13             NORMAL FOR A KEYPAD
        STA     PROD1           SAVE DATA 1
        LDA     SETSN           GET "SENSOR NUMBER"
        ASL     A               LSB IN BIT 1
        AND     #02             SAVE ONLY BIT 1
        BRCLR   6,SETOPT,EKFSO  FS BIT IS 0
        ORA     #40             SET FS BIT
EKFSO   STA     PROD2           SAVE DATA 2
        BRA     EPRGM           PROGRAM IT
ESENS   LDA     SETSN+1         GET EIGHT'S DIGIT
        LSL     A               IN EIGHT'S POSITION
        LSL     A
        LSL     A
        ORA     SETSN           GET ONES DIGIT
        STA     PROD1           BINARY SENSOR NUMBER
        LDA     #08             INIT PROD2 TO SHIFT IN OPTIONS
        STA     PROD2
        LDA     SETOPT          GET OPTIONS
        LSR     A               SHIFT 3 BITS INTO DATA 2
        ROR     PROD2
        LSR     A
        ROR     PROD2
        LSR     A
        ROR     PROD2
        STA     PROD3           REMAINDER IS DATA 3
*****************************************************************
*       PROGRAM DEVICE                                          *
*****************************************************************
EPRGM   LDA     #FF             INSURE PORT B ALL OUTPUTS
        STA     HDDRB
        BSET    7,HPORTA        RF HIGH
        BSET    6,HPORTB        TAMPER HIGH
        BCLR    7,HPORTB        SENSOR LOW
        TST     A               4 CYCLE NOP
        TST     A
        BCLR    6,HPORTB        TAMPER LOW
        LDA     PROHC           GET HOUSE CODE
```

```
        LDX     #7              8 BITS
        JSR     BITOUT          OUTPUT IT
        LDA     PROD1           GET DATA 1
        LDX     #5              6 BITS
        JSR     BITOUT          OUTPUT IT
        LDA     PROD2           GET DATA 2
        LDX     #7              8 BITS
        JSR     BITOUT          OUTPUT IT
        BRCLR   2,FLAGS,PKPD    SKIP IF KEYPAD
        LDA     PROD3           GET DATA 3
        LDX     #5              6 BITS
        JSR     BITOUT          OUTPUT IT
PKPD    BCLR    7,HPORTA        RF LOW
        BCLR    6,HPORTB        TAMPER LOW
        BSET    7,HPORTB        SENSOR HIGH
        JSR     JREAD           READ IT AGAIN
        LDA     PROHC           GET HOUSE CODE
        CMP     REDHC           READ CORRECTLY?
        BNE     PFAIL           NO.
        BRSET   2,FLAGS,CSENS   SENSOR
        LDA     PROD2           GET DATA 2
        EOR     REDD2           COMPARE WITH DATA READ
        AND     #F2             ONLY CERTAIN BITS
        BNE     PFAIL           FAIL
        BRA     PDONE           DONE
CSENS   LDA     PROD1           GET DATA 1
        EOR     REDD1           READ CORRECTLY?
        AND     #3F             6 BITS
        BNE     PFAIL           NO.
        LDA     PROD2           GET DATA 2
        EOR     REDD2           READ CORRECTLY?
        AND     #F0             4 BITS
        BNE     PFAIL           NO.
        LDA     PROD3           GET DATA 3
        EOR     REDD3           READ CORRECTLY?
        AND     #3F             6 BITS
        BNE     PFAIL           NO.
PDONE   LDX     #TMDON-TMSG     DONE MESSAGE
        JMP     JMESG
PFAIL   LDX     #TMFAL-TMSG     FAIL MESSAGE
        JMP     JMESG           SHOW IT

*****************************************************************
*       SLEEP KEY                                               *
*****************************************************************
NENTER  CPX     #QSLEEP         SLEEP KEY?
        BNE     NSLEEP          NO
        JSR     JREAD           READ DEVICE
        BRCLR   2,FLAGS,PDONE   NOTHING TO DO FOR KEYPAD
        LDA     #20             SLEEP BIT SET
        STA     PROD3           IN DATA 3
        JMP     EPRGM           PROGRAM IT
*****************************************************************
*       EXAMINE OFF KEY COMBINATION                             *
*****************************************************************
NSLEEP  CPX     #QEXOFF         EXAM OFF?
        BEQ     EXOFF           YES
        JMP     ERROR           ERROR TRAP AND DISPLAY
EXOFF   CLR     EXADD+3         MESS UP 'RTS' INSTRUCTION

*****************************************************************
*       DISPLAY CURRENT SETTINGS                                *
*****************************************************************
```

```
JDISP   BCLR    1,FLAGS         NUMBER SETTINGS DO FLASH
DSPON   LDX     SETHC+2         HOUSE CODE HUNDREDS
        BNE     NBLKH           NOT ZERO
        LDX     #10             BLANK
NBLKH   LDA     T7SEG,X         GET PATTERN
        STA     DSPHC           DISPLAY IT
        LDX     SETHC+1         HOUSE CODE TENS
        BNE     NBLKT           NOT ZERO
        LDA     SETHC+2         GET HUNDREDS
        BNE     NBLKT           NOT ZERO SO DON'T BLANK TENS
        LDX     #10             BLANK
NBLKT   LDA     T7SEG,X
        STA     DSPHC+1
        LDX     SETHC           HOUSE CODE ONES
        LDA     T7SEG,X
        STA     DSPHC+2
        LDX     SETSN+1         SENSOR NUMBER EIGHTS
        BNE     NBLKE           NOT ZERO
        LDX     #10             BLANK
NBLKE   LDA     T7SEG,X
        STA     DSPSN
        LDX     SETSN           SENSOR NUMBER ONES
        LDA     T7SEG,X
        STA     DSPSN+1
        LDA     SETOPT          OPTIONS
        STA     DSPOPT
        JMP     WAIT            WAIT FOR INTERRUPT

*****************************************************************
*       READ DATA FROM TRANSMITTER                              *
*****************************************************************
JREAD   LDA     #08             MUST BE QUIET FOR AT LEAST 8 MS
        STA     RTEMP           SAVE IT FOR LATER COMPARE
        CLR     A
        STA     COUNTS          INIT TIMER
RNTIME  BIH     NRSTRT          RF LOW. DON'T RESTART 8 MS
        ADD     #08             SET TIMER 8 MS FROM NOW
        STA     RTEMP           SAVE IT FOR COMPARE
NRSTRT  LDA     COUNTS          GET CURRENT TIME
        CMP     #48             WAITED MORE THAN 72 MS?
        BEQ     RFAIL           YES. THIS IS AN ERROR.
        CMP     RTEMP           WAITED LONG ENOUGH?
        BNE     RNTIME          NOT YET.
        BSET    7,HPORTA        PULL RF HIGH
        BSET    6,HPORTB        TAMPER HIGH
        BCLR    7,HPORTB        SENSOR LOW
        TST     A               4 CYCLE NOP
        TST     A
        BCLR    6,HPORTB        TAMPER LOW
        LDA     #BF             TAMPER BECOMES AN INPUT
        STA     HDDRB           DIRECTION REGISTER B
        LDX     #7              READ 8 BITS
        JSR     BITIN           GET IT
        STA     REDHC           SAVE BINARY HOUSE CODE
        LDX     #5              READ 6 BITS
        JSR     BITIN           GET IT
        STA     REDD1           SAVE DATA 1
        LDX     #7              READ 8 BITS
        JSR     BITIN           GET IT
        STA     REDD2           SAVE DATA 2
        AND     #01             KEYPAD OR SENSOR?
        BNE     RSENS           SENSOR.
        LDA     REDD1           GET DATA 1
```

```
        AND     #1F             IGNORE BIT 5
        CMP     #13             CORRECT FOR KEYPAD?
        BNE     RSENS           NO, BUT IT MIGHT BE A SENSOR.
        BCLR    2,FLAGS         INDICATE KEYPAD
        BRA     REND            END OF READ
RSENS   LDX     #5              READ 6 BITS
        JSR     BITIN           GET IT
        STA     REDD3           SAVE DATA 3
        BSET    2,FLAGS         INDICATE SENSOR
REND    BCLR    7,HPORTA        RF LOW
        LDX     #FF             RETURN PORT B TO OUTPUTS
        STX     HDDRB           SAVE IT
        ORA     REDD2
        ORA     REDD1
        ORA     REDHC
        BSET    7,HPORTB        SENSOR HIGH
        BCLR    6,HPORTB        TAMPER LOW
        BEQ     RFAIL           NO BITS SET SO INDICATE FAILURE
        RTS                     RETURN
RFAIL   RSP                     CLEAR STACK
        LDX     #TMFAL-TMSG     FAIL MESSAGE
        JMP     JMESG           SHOW IT

*****************************************************************
*       READ IN X+1 BITS                                        *
*****************************************************************
BITIN   LDA     #80H            1 INDICATES DONE
        STA     RTEMP           SAVE IT
BITIN1  LDA     HPORTB          READ TAMPER
        BSET    7,HPORTB        SENSOR (CLOCK) HIGH
        ASL     A               IN CARRY
        ASL     A
        BCLR    7,HPORTB        SENSOR (CLOCK) LOW
        ROR     RTEMP           ROTATE IN
        DEC     X               COUNT BITS
        BPL     BITIN1          BACK TILL RIGHT NUMBER READ
        LDA     RTEMP           GET DATA READ
        EOR     #FF             IT IS INSIDE OUT
        BCS     BITRTS          DONE
BITIN2  LSR     A               RIGHT JUSTIFY IT
        BCS     BITIN2
BITRTS  RTS

*****************************************************************
*       OUTPUT X+1 BITS TO TRANSMITTER                          *
*****************************************************************
BITOUT  BCLR    7,HPORTB        SENSOR (CLOCK) LOW
        LSR     A               GET BIT TO SEND IN CARRY
        BCS     BITONE          SEND A ONE
        BSET    6,HPORTB        TAMPER (/DATA) HIGH
        BRA     BITEND          SKIP
BITONE  BCLR    6,HPORTB        TAMPER (/DATA) LOW
BITEND  BSET    7,HPORTB        SENSOR (CLOCK) HIGH
        DEC     X               SENT ENOUGH YET?
        BPL     BITOUT          NO
        RTS                     RETURN

*****************************************************************
*       TIMER INTERRUPT                                         *
*****************************************************************
INTMR   LDA     #02             CLEAR TIMER INTERRUPT FLAG
        STA     HTCONT          TIMER CONTROL
        CLR     X               CLEAR FREQ SHIFT MASK
```

```
        LDA     HPORTA          GET PORT A
        AND     #80             SAVE BIT 7
        STA     HPORTA          BLANK DISPLAY
        LDA     KLOW            GET KEYBOARD LOW AND SCAN POINTER
        CMP     #05             LAST DIGIT?
        BNE     NKL5            NO.
        LDA     KNEW            GET PREVIOUS 'NEW' KEY
        STA     KOLD1           NOW IT IS OLD.
        LDA     KEY1            GET KEYS THIS SCAN
        BEQ     KILGL           ILLEGAL KEY COMBO
        DEC     A               CONVERT TO KEY NUMBER
        STA     KNEW            SAVE FOR DEBOUNCE
KILGL   LDA     #FF             GET READY FOR NEXT SCAN
        STA     KEY1            DO IT
        LDA     HPORTC          GET FREQ SHIFT INPUT
        STA     FSOFF           SAVE IT
        INC     X               MASK IT OFF FOR KEYBOARD SCAN
NKL5    TXA                     GET MASK IN A
        ORA     HPORTC          GET SCAN INPUTS
        AND     #0FH            ONLY A FOUR BIT PORT
        TAX                     INDEX INTO HIGH BIT TABLE
        LDA     TKHIGH,X        GET HIGH BITS
        ORA     KLOW            GET LOW BITS
        TAX                     INDEX INTO KEYBOARD TABLE
        LDA     TKTAB,X         GET KEY NUMBER + 1
        AND     KEY1            FF FOR ALL EXCEPT ONE PASS
        STA     KEY1            SAVE IT
        INC     KLOW            INCREMENT SCAN COUNT
        LDA     HPORTB          GET OUTPUT PORT B
        AND     #C0             PRESERVE BITS 6 AND 7
        STA     PBOUT           SAVE IT
        LDA     HPORTB          GET OUTPUT PORT B
        LSL     A               SHIFT SCAN TO NEXT DIGIT
        AND     #3F             BUT ONLY 6 DIGITS
        BNE     NLOZ            NOT LAST DIGIT
        STA     KLOW            START SCAN OVER
        LDA     #01             WITH FIRST DIGIT
NLOZ    ORA     PBOUT           SAVE BITS 6 AND 7
        STA     HPORTB          OUTPUT IT
        LDX     KLOW            GET SCAN NUMBER
        LDA     DSPHC,X         GET CHARACTER TO DISPLAY
        AND     #7F             WITH BIT 7 CLEAR
        ORA     HPORTA          PRESERVE BIT 7
        STA     HPORTA          DISPLAY ON AGAIN
        INC     COUNTS          INDICATE INTERRUPT OCCURRED
        RTI                     RETURN
*****************************************************************
*       EXTERNAL INTERRUPT                                      *
*****************************************************************
INEXT   RTI                     NO EXTERNAL INTERRUPT

*****************************************************************
*       SOFTWARE INTERRUPT                                      *
*****************************************************************
INSWI   RTI                     NO SOFTWARE INTERRUPT

*****************************************************************
*       INTERRUPT AND RESET VECTORS                             *
*********************

*****************************************************************
*       INTERRUPT AND RESET VECTORS                             *
*****************************************************************
```

```
        ORG     7F6
INWAIT  EQU     INTMR
        DW      INWAIT          TIMER WAIT INTERRUPT VECTOR
        DW      INTMR           TIMER INTERRUPT VECTOR
        DW      INEXT           EXTERNAL INTERRUPT VECTOR
        DW      INSWI           SOFTWARE INTERRUPT VECTOR
        DW      INIT            RESET VECTOR
        END
```

While the present invention has been described with respect to its presently preferred embodiments and particularly enumerated circuitry used therein, it is to be appreciated that various modifications may be made thereto by those of skill in the art without departing from the spirit and scope of the invention. Accordingly, it is contemplated that the following claims should be interpreted so as to include all those equivalent embodiments within the spirit and scope of the above-described invention.

What is claimed is:

1. A security system comprising:

(a) a plurality of transducers, each transducer operable to detect an alarm condition;

(b) a plurality of radio frequency transmitters, each integrally connected to one of said transducers for transmitting encoded status messages including unique transducer identification data and the alarm state of its associated transducer, and wherein each transmitter includes;

(i) means for storing transmitter identification data and ones of a plurality of message preconditioning parameters peculiar to each transmitter's associated transducer, and (ii) means for responsively monitoring its associated transducer's alarm state relative to its programmed preconditioning parameters and transmitting an alarm message upon the confirmation of a valid change in state; and (iii) means for pulse position encoding each status message into a plurality of constant duration data frames, each including a shorter duration data pulse of a constant duration from frame to frame at an encoded time displacement therein;

(c) means for serially programming each transmitter's storage means with its identification data and those preconditioning parameters appropriate to the type of transducer coupled thereto; and (d) system controller means responsive to status messages from each of said transmitters for decoding received messages and alerting off-site monitoring means with the occurrence of ones of said messages.

2. Apparatus as set forth in claim 1 including means for determining an even and odd parity condition of each status message as it is transmitted and for transmitting the detected parity conditions with each status message.

3. A system as set forth in claim 1 wherein each transmitter includes means responsive to one of said preconditioning parameters for delaying the transmission of an alarm message a predetermined amount of time after detecting its associated transducer's change of state.

4. A system as set forth in claim 1 wherein each transmitter includes means responsive to one of said preconditioning parameters or establishing the alarm state of its associated transducer.

5. A system as set forth in claim 4 wherein each transmitter includes means responsive to one of said preconditioning parameters for sensing a change in transducer state from an alarm state to a non-alarm state and transmitting a restore message.

6. A system as set forth in claim 1 wherein each transmitter includes means responsive to one of said preconditioning parameters for periodically transmitting a current status message of its associated transducer, regardless of its alarm status.

7. A system as set forth in claim 1 wherein each transmitter includes means responsive to one of said preconditioning parameters for selectively disabling the transmitter and preventing message transmissions, regardless of the state of its associated transducer.

8. A system as set forth in claim 1 wherein each transmitter is encased in an enclosure and includes means responsive to the opening of said enclosure for transmitting a tamper message upon the opening thereof.

9. A system as set forth in claim 1 wherein each transmitter includes means responsive to ones of said preconditioning parameters for sequentially transmitting each status message a number of times, wherein the particular number of message transmissions is prioritized relative to the type of condition its associated transducer monitors and the condition causing the transmission.

10. A system as set forth in claim 9 wherein each transmitter includes means responsive to its identification data for delaying the transmission of each status message after the first a unique amount of time different from all other radio frequency transmitters in the system.

11. A system as set forth in claim 1 wherein said programming means includes means for non-destructively interrogating and displaying each transmitter's programmed identification data and preconditioning parameters.

12. A system as set forth in claim 1 wherein the data of each status message comprises a house number, a sensor transmitter number, error detection data, the transmitter type, alarm transition data and transducer current status data.

13. A system as set forth in claim 1 wherein the data pulse of each data frame defines two binary bits of information.

14. A system as set forth in claim 1 including at least one means operable by a system user for programming the response of said system controller means to transmissions received from said transmitters comprising:

(a) a data entry keyboard having a plurality of keys;

(b) means for decoding which and the number of times each of said keys are depressed;
(c) register means responsive to said programming and decoding means for storing programmed identification data and decoded key stroke data;
(d) means for pulse position encoding the contents of said register means into a plurality of constant duration data frames, each including a shorter duration data pulse of a constant duration from frame to frame at an encoded time displacement therein; and
(e) means for transmitting at radio frequencies said pulse position encoded messages to said system controller, said system controller including means responsively setting ones of its operating parameters relative thereto.

15. A system as set forth in claim 14 including means for alternately varying the radio frequency at which each user entered message is transmitted, from one message to the next.

16. In a security system apparatus operable by a system user for programming the response of a system controller responsive to a plurality of distributed transducers and associated radio frequency transmitters, each transmitting encoded status messages, including identification data and the transducer alarm state, said apparatus comprising:
(a) a data entry keyboard having a plurality of keys;
(b) means for decoding which and the number of times each of said keys are depressed;
(c) register means for serially storing programmed identification data and decoded key stroke data;
(d) means for pulse position encoding the contents of said register means into a plurality of constant duration data frames, each including a shorter duration data pulse of a constant duration from frame to frame at an encoded time displacement therein and into a user message;
(e) means for repetitively transmitting at radio frequencies each pulse position encoded user message to said system controller, wherein the particular number of message transmissions is prioritized relative to the type of entered message and said system controller includes means responsively setting ones of its operating parameters relative thereto; and
(f) means detachably coupling to said apparatus for selectively programming said register with unique identification data.

17. Apparatus as set forth in claim 16 including means for determining an even and odd parity condition of each user message as it is transmitted and for transmitting the detected parity conditions with each user message.

18. Apparatus as set forth in claim 16 including tone generator means responsive to the depression of said keys for producing a corresponding audible feedback signal confirming each user message transmission.

19. Apparatus as set forth in claim 18 including means responsive to depressions of ones of said keys for preventing a user message transmission until the key remains depressed at least a preset amount of time, the elapsing of said time duration being indicated by a unique audible feedback.

20. In a security system having a plurality of distributed transducers, each monitoring an alarm condition, at least one transmitter integrally coupled to one of said transducers for communicating the status thereof to a system controller comprising:
(a) means for monitoring the state of said transducer;
(b) first means for storing ones of a plurality of programmed message preconditioning parameters peculiar to said transducer;
(c) second means for storing transmitter identification data and transducer status data;
(d) means for pulse position encoding the contents of said second means into a plurality of constant duration data frames, each including a shorter duration data pulse of a constant duration from frame to frame at an encoded time displacement therein;
(e) means responsive to changes in transducer state relative to ones of said preconditioning parameters and the occurrence of conditions defined by others of sald preconditioning parameters for repetitively transmitting said pulse position encoded radio frequency status messages, each message including said identification data, transducer alarm transition data and transducer current status data, a proioritized number of times, the specific number depending upon the type of event inducing the transmission.

21. A transmitter as set forth in claim 20 wherein sald first and second storage means comprises a recircluating shift register and said transmitter includes means detachably coupling thereto for selectively programming said transmitter with unique identification data and ones of said preconditioning parameters appropriate to the type of transducer coupled thereto and nondestructively interrogating and displaying the identification data and preconditioning parameters programmed into said transmitter.

22. In a security system including a plurality of distributed transducers operable to detect environmental alarm conditions and an on-site system controller monitoring status information from each of said transducers, improved apparatus for reporting at least one transducer's alarm status to said system controller, the improvement comprising, a short range radio frequency transmitter connected to one of said transducers and including means for transmitting status messages including identification data and the alarm state of its associated transducer, said transmitter further including:
(a) electrically programmable means for storing said identification data and a plurality of message preconditioning parameters peculiar to said transmitter's associated transducer; and
(b) means responsive to changes in transducer state relative to ones of said preconditioning parameters and the occurrences of conditions defined by others of said preconditioning parameters for transmitting encoded status messages to said system controller in response to selected ones of detected changes and conditions other than an alarm state change.

23. Apparatus as set forth in claim 22 including means for transmitting each status message a prioritized number of times, the number depending upon the type of event inducing said transmission.

24. Apparatus as set forth in claim 23 including a plurality of improved transmitters and wherein each transmitter further includes means responsive to its prorammed transmitter identification data for establishing a related intermessage delay between the messages of each status mesage transmission different from that of the others of said plurality of transmitters whereby the system controller may further distinguish each of its distributed transducers.

25. Apparatus as set forth in claim 22 including timing means responsive to ones of said preconditioning parameters and changes in transducer state for controlling status message transmissions in relation thereto.

26. Apparatus as set forth in claim 22 wherein ones of said transducers comprise a reed switch and a magnet, wherein said magnet is separately mounted from said reed switch and said reed switch and its associated transmitter are mounted in an enclosure adjacent said magnet such that the contacts of said reed switch are normally biased to a non-alarm position.

27. Apparatus as set forth in claim 22 including means responsive to one of said preconditioning parameters for establishing a lockout time and wherein said monitoring means includes resettable timing means responsive to said lockout time and a change in transducer state for transmitting a status message upon the occurrence of an initial state change and preventing the transmission of messages for successively detected state changes until the timing out of said timer means.

28. Apparatus as set forth in claim 22 including means responsive to one of said preconditioning parameters for establishing a smoke delay time and wherein said monitoring means includes resettable timing means responsive thereto for delaying the transmission of a status message until the timing out of said timing means.

29. Apparatus as set forth in claim 22 including means responsive to at least one of said preconditioning parameters for establishing a message re-transmission multiple and wherein said monitoring means includes means responsive thereto for repeating each status message a corresponding number of times.

30. Apparatus as set forth in claim 22 including means responsive to one of said preconditioning parameters for establishing a restore re-transmission multiple and wherein said monitoring means includes means responsive thereto when the status of its associated transducer switches from its alarm state to its non-alarm state for repetitively transmitting a corresponding status message a different number of times than when said transducer changes from its non-alarm state to its alarm state.

31. Apparatus as set forth in claim 22 including means responsive to one of said preconditioning parameters for establishing an emergency re-transmission multiple such that said monitoring means repetitively transmits a different number of status messages when said transducer changes to an alarm state as it would otherwise transmit.

32. Apparatus as set forth in claim 22 including means responsive to one of said preconditioning parameters for establishing a default time and wherein said monitoring means includes resettable timing means responsive thereto for transmitting its transducer's status each time said timing means times out.

33. Apparatus as set forth in claim 22 including means responsive to one of said preconditioning parameters for establishing the alarm state of said transducer and wherein said monitoring means includes means responsive thereto for comparing the actual transducer state to said defined alarm state prior to transmitting a status message.

34. Apparatus as set forth in claim 22 wherein said storage means comprises a recirculating shift register and said programming means includes display means and further includes means for non-destructively interrogating and displaying the identification data and preconditioning parameters previously programmed into each transmitter.

35. Apparatus as set forth in claim 22 including means responsive to one of said preconditioning parameters for establishing a transmission frequency and wherein said monitoring means includes means responsive thereto for transmitting each status message at a selected one of a plurality of frequencies.

* * * * *